US005701657A

United States Patent [19]

Sakamoto

[11] Patent Number: 5,701,657

[45] Date of Patent: Dec. 30, 1997

[54] METHOD OF MANUFACTURING A REPULSION MAGNETIC CIRCUIT TYPE LOUDSPEAKER

[75] Inventor: Yoshio Sakamoto, Hachioji, Japan

[73] Assignee: Kabushiki Kaisha Kenwood, Tokyo, Japan

[21] Appl. No.: 265,146

[22] Filed: Jun. 24, 1994

[30] Foreign Application Priority Data

Jun. 30, 1993 [JP] Japan ..... 5-183450

[51] Int. Cl.[6] ..... H04R 31/00

[52] U.S. Cl. ..... 29/594; 29/609.1

[58] Field of Search ..... 381/199, 201, 381/192, 194, 197; 29/602.1, 594, 609.1

[56] References Cited

U.S. PATENT DOCUMENTS

| | | |
|---|---|---|
| 3,665,352 | 5/1972 | Dietrich et al. . |
| 4,461,932 | 7/1984 | Oyaba . |
| 4,472,604 | 9/1984 | Nakamura et al. . |
| 4,896,086 | 1/1990 | Miyahara et al. . |

FOREIGN PATENT DOCUMENTS

| | | |
|---|---|---|
| 0538702A2 | 10/1992 | European Pat. Off. . |
| WO9104129 | 1/1991 | WIPO . |

OTHER PUBLICATIONS

Patent Abstracts of Japan; vol. 15, No. 481 (M-1187) 6 Dec. 1991 & JP-A-32 007 629 (Tokin) 10 Sep. 1991 *abstract*.

*Primary Examiner*—Carl E. Hall

*Attorney, Agent, or Firm*—Sixbey, Friedman, Leedom & Ferguson, P.C.; Gerald J. Ferguson, Jr.; Eric J. Robinson

[57] ABSTRACT

A repulsion magnetic circuit type loudspeaker which is compact and easy to assemble, and a method of easily manufacturing such a repulsion magnetic circuit type loudspeaker by using conventional loudspeaker manufacturing lines. The repulsion magnetic circuit has two magnets magnetized in the thickness direction and disposed with the same polarity being faced each other, and a center plate being squeezed between the two magnets. A magnetic field is generated by repulsive fluxes at the outer peripheral area of the center plate. A voice coil is disposed in the magnetic field. In the manufacturing method, a coupling member of either a concave or a convex is formed at each of the contact planes of the magnets and center plate. The coupling members are engaged with each other to assemble the repulsion magnetic circuit. The repulsion magnetic circuit is mounted on a speaker frame with position alignment therebetween, by forming a convex or concave at the speaker frame, the convex or concave matching a concave or convex formed at the lower magnet.

13 Claims, 20 Drawing Sheets

METHOD OF MANUFACTURING A REPULSION MAGNETIC CIRCUIT TYPE LOUDSPEAKER

BACKGROUND OF THE INVENTION

1. Field of the Invention

The present invention relates to a loudspeaker and manufacturing method and apparatus, the loudspeaker (hereinafter called a repulsion magnetic circuit type loudspeaker) having a magnetic circuit (hereinafter called a repulsion magnetic circuit) wherein two magnets magnetized in the thickness direction are disposed with the same polarity being faced each other, a center plate made of soft magnetic material is squeezed between the two magnets, a magnetic field of repulsion magnetic fluxes is generated on an outer periphery of the center plate.

2. Related Background Art

Conventional general loudspeakers are classified mainly into a type using an outer magnet type magnetic circuit such as shown in FIG. 16 and a type using an inner magnet type magnetic circuit such as shown in FIG. 17. Most of current loudspeakers use the former inner magnet type magnetic circuit. In FIGS. 16 and 17, reference numeral 1 represents a magnet, reference numeral 4 represents a yoke, and reference numeral 5 represents a top plate.

In a conventional loudspeaker manufacturing method, magnetic circuit components such as the magnet 1, yoke 4, and top plate 5 and vibrating system components such as a voice coil 6, a damper 7, and a diaphragm 8 are mounted on a speaker frame 2, and the magnets 1 are magnetized generally as the last process. A manufacturing line and method will be described with reference to FIGS. 18 to 28. A manufacturing line is constructed of transport units for intermittently transporting pallets P at a predetermined space therebetween, and work stations for performing each process. The work stations include automatic stations Sa installed with automatic assemblers and manual stations So with operators op, forming a semi-automatic line. The work stations are constructed mainly of a magnetic circuit assembly line Lm, vibrating system assembly lines Ld1, Ld2, and Ld3, and a dry line Lo for drying adhesive agent, as shown in FIG. 18.

The manufacturing method at the manufacturing line will be described. At the magnetic circuit assembly line Lm, a yoke 4 is supplied from a supply station Sa4 to a transport pallet P on the transport line by using a loader R4. The relationship between the transport line and a transport pallet P is shown in FIG. 19. A transport pallet P is placed on a transport belt B. The width of the transport belt B is about 30 mm. Two transport belts are disposed in parallel and spaced generally by the same distance as the width of the transport pallet P. As the belts B are intermittently moved by a predetermined distance in a predetermined transport direction by a driving unit, the pallet P is also transported.

A lift U for lifting a pallet P is mounted under the belts B at each station Sa, So. After each pallet P is moved to each station Sa, So and stopped at a predetermined position, the lift U lifts the pallet P above the belts B. As shown in FIG. 20, positioning pins U1 on the top of the lift U are inserted into positioning holes P3 formed in the pallet P, to thereby fix the pallet P at a desired position of the station Sa, So. At a station Sa and the like where an unfinished product on the pallet P is required to be rotated for example for coating adhesive agent or for other operations, the upper portion of the lift U is made rotatable while lifting the pallet P.

The rotary mechanism of the pallet P operates in the following manner. When a pallet P is moved to a desired station Si, a sensor at the station Sa is activated so that the lift U lifts the pallet P as well as an unfinished product thereof and rotates them. A nozzle tip of an adhesive automatic coating unit lowers to a predetermined position of the product, jets out adhesive agent by a predetermined amount to coat it on the surface of the product. For the coating control, the pallet P rotates by about 1.5 to 2 times.

Not only the magnetic circuit components but also vibrating system components of a loudspeaker are assembled by bonding. The type of an adhesive automatic coating unit includes a coating nozzle moving type and the above-described transport pallet rotating type. With the coating nozzle moving type, a nozzle is mounted on a rotary disk and the disk is rotated to coat adhesive agent to a desired surface of a product. This type is advantageous for coating adhesive agent on the surface of a product having a relatively flat surface and small diameter, and is used at some stations of the magnetic circuit assembly line Lm. The transport pallet rotating type is used for coating adhesive agent on the surface of a product having a large diameter, such as coating a large magnetic circuit, coating for bonding the outer periphery of a voice coil 6 and the outer periphery of a cone diaphragm 8, coating a narrow area such as for bonding the outer periphery of a voice coil 6 and the neck of a cone diaphragm 8. Particularly, this type is often used by coating adhesive agent at a vibrating system assembly line.

As shown in FIG. 19, the center of the transport pallet P has a positioning center guide pin P1 worked to have a diameter of 6 mm and a conical top of 60°. The guide pin is provided with a spring P2 so that the guide pin P1 can move up and down by about 1 to 2 mm. The bottom 42 of the yoke 4 is formed with a center positioning hole 41 corresponding to the center guide pin P1 as shown in FIG. 19. The hole 41 has an opening diameter of 6 mm and a conical shape of 60° in section extending from the yoke bottom to the apex 44 of a yoke pole 43. In mounting a yoke 4 on the transport pallet P, the center guide pin P1 of the pallet P is inserted into the center positioning hole 41 of the yoke so that the center of the transport pallet P coincides with the center of the yoke 4 to achieve the mutual positioning. At any one of the succeeding processes, positioning is achieved by the center positioning hole 41 and the center guide pin P1. The center positioning hole 41 therefore has a very important function.

The transport pallet P with the yoke 4 is moved to the next coating station. As shown in FIG. 20, adhesive agent a is coated by a predetermined amount to the bonding surface of the yoke, i.e., the surface 45 to which a magnet 1 is bonded. The pallet P with the 4 yoke coated with the adhesive agent is transported to the next process whereat an non-magnetized magnet 1 is pressed onto the magnet bonding surface 45 of the yoke 4 by a loading unit as shown in FIG. 21. At the next process shown in FIG. 22, the upper surface of the magnet 1 is coated with adhesive agent. At the next process shown in FIG. 22, the inner peripheral portion jg2 of the gap jig Jg is fitted on the outer peripheral portion 46 of a top portion 44 of a yoke pole 43 so as to precisely determine a magnetic gap.

At the next process, a top plate 5 which is the last magnetic circuit component to be assembled is coupled to the magnet 1 while forcibly inserting the inner peripheral portion of the top plate 5 into the outer peripheral portion Jg1 of the gap jig Jg. As shown in FIG. 24, a speaker frame 2 is mounted on the top plate 5 by means of caulking or the like. Input terminals 9 have been mounted on the speaker frame in advance. For the time period necessary for curing the adhesive agent a, the transport pallet is moved along the line while the gap jig Jg is being inserted. At a gap jig dismounting station shown in FIG. 25, the gap jig Jg is dismounted to complete a magnetic circuit having a predetermined magnetic gap G and the speaker frame 2 with input terminals 9, to thus manufacture an unfinished product.

The unfinished product having an assembled magnetic circuit with the speaker frame 2 and input terminals being mounted is then sequentially transported to the vibrating system assembly lines Ld1, Ld2, and Ld3. At each station Sa, So for the processes at the lines Ld1, Ld2, and Ld3, vibrating system components such as a voice coil 6, a damper 7, and a cone diaphragm 8 are assembled. After the wiring process and an adhesive agent drying process, an unfinished loudspeaker product shown in FIG. 26 is obtained. At a magnetizing station SaM near the last process of the vibrating system component assembly line Ld3, the magnets 1 are magnetized. In this case, as shown in FIGS. 27 and 28, since a magnetizing coil MC is generally mounted above the vibrating system component assembly line Ld3, the unfinished loudspeaker product is turned upside down on the transport pallet P, and the transport pallet P with the unfinished loudspeaker product is raised to move the magnetic circuit mounted on the speaker frame 2 to generally the center of the magnetizing coil MC. A predetermined amount of current is applied to the magnetic coil MC to magnetize the magnets 1. After this magnetizing process, the magnetized magnetic circuit can vibrate the vibrating system and allows sounds to be generated. After a delivery check process, the loudspeaker is finished. The assembly method for an inner magnet type loudspeaker shown in FIG. 17 is basically the same as the above-described method for an external magnet type loudspeaker.

As described above, with a conventional magnetic circuit assembly method, a magnetized magnet 1 is not used at the earlier processes. The reason for this is that if a magnetized magnet is used, the assembly of other components becomes very difficult, and in the worst case, it becomes impossible. Therefore, there is presently no merit of using a magnetized magnet. For example, if the magnetized magnet 1 is transported by the loading unit, at the magnetic circuit assembly line, from the magnet supply station to the upper area of the yoke 4 on the transport pallet P, the yoke is attracted by the magnet 1 against the control of the loading unit, being unable to correct the position of the yoke 4. In other words, the magnet 1 is attached to the yoke at a position displaced from the correct position, outside of a predetermined allowance range. It occurs often that the inner peripheral portion of the magnet 1 contacts the outer peripheral portion of the yoke pole.

Even if the magnet circuit components such as a yoke 4, magnet 1, and plate 5 are correctly attached by any chance, magnetic fluxes are concentrated upon the magnetic gap G defined by the outer periphery 46 of a pole 43 and the inner periphery 51 of a plate 5 shown in FIG. 25, generating an extraordinary strong attraction force at the magnetic gap G. As a result, the plate inner periphery 51 and the pole outer periphery 46 attract each other, and parts of the plate inner periphery 51 and pole outer periphery 46 may tightly contact each other. Until the adhesive agent a for assembling a magnetic circuit, particularly the adhesive agent a for bonding the plate 5 and magnet 1, is cured to have a predetermined adhesive strength, the magnetic gap G, i.e., parts of the inner periphery 51 of the plate 5 and the yoke outer periphery 46 squeeze parts of the inner and outer peripheries jg2 and jg1 of the gap jig Jg by a very strong force. Under such a condition, the adhesive agent a is cured.

After the magnetic circuit has been completely assembled, the gap jig Jg is dismounted by using a jig dismount unit made of such as a combination of air cylinders. However, it is impossible to dismount the gap jig jg even if the jig dismount unit is operated normally at a normal power, frequently stopping the lines. If the power of the jig dismount unit is raised and the gap jig jg is dismounted at a force greater than the adhesive strength between the magnetic gap G and the gap jig jg, the gap jig jg or the like may be often destroyed.

As described above, in a conventional loudspeaker assembly method, it is general to use a non-magnetized magnet and magnetize it after the vibrating system components and the like have been assembled into a loudspeaker.

Such a loudspeaker manufacturing method including magnetizing as the last process is, however, impossible to use for a repulsion magnetic circuit type loudspeaker. Specifically, as shown in FIG. 29, a repulsion magnetic circuit has two magnets 1, 1 magnetized in the thickness direction with the same polarity facing each other, a center plate 3 made of soft magnetic material being squeezed between the magnets, and a magnetic field of repulsion fluxes is generated on the outer periphery side of the center plate 3. It is practically impossible under the current techniques to magnetize the non-magnetized magnet 1 after the repulsion magnetic circuit and vibrating system have been assembled, even if the structures of the magnetizer and a magnetizing coil are modified.

For example, a magnetizing coil MC shown in FIG. 27 is used for a loudspeaker having a conventional magnetic circuit, and magnetizes a single magnet in one direction. If the non-magnetized magnets i of the repulsion magnetic circuit are magnetized by using this magnetizing coil MC, the magnets are magnetized in one direction, being unable to form a repulsion magnetic circuit. In order to magnetize a repulsion magnetic circuit assembled with non-magnetized magnets 1, two repulsion magnetic fields symmetrical to the center plate 3 are required to be generated. However, with the current techniques, it is very difficult to generate such two magnetic fields from the view point of the structure of magnetizing coils and the whole structure of a loudspeaker, particularly the positional arrangement between the magnetic circuit and speaker frame 2.

The applicant has proposed a repulsion magnetic circuit type loudspeaker such as shown in FIG. 29. As shown in FIG. 30, this loudspeaker has holes 16 and 36 formed in the central areas of magnets 1 and center plate 3. A support shaft Mp having an outer dimension matching the inner dimension of the holes 16 and 36 is mounted on a speaker frame 2. The support shaft Mp is inserted into the holes 16 and 36 of the magnets 1 and center plate 3 to thereby assemble a magnetic circuit. This approach is effective for a loudspeaker providing a wide contact area between the magnets 1 and center plate 3, i.e., a loudspeaker having a relatively large diameter of a voice coil 6, and for reducing the weight of the loudspeaker by forming the holes 16 in the magnets 1.

Assuming the same magnet area, the magnetic efficiency improves the larger the contact area between the magnet 1 and a center plate 3 of the magnetic circuit components. If reducing the weight of the magnet 1 is not taken into consideration, the hole 16 is not necessary. If the weight is reduced by reducing the diameter of a voice coil 6 and the sizes of the magnet 1, center plate 3, and the like, the hole 16 reduces the contact area between the magnet 1 and center plate 3, and the volume of the magnet 1 is reduced, resulting in insufficient magnetic energy.

The repulsion magnetic circuit type loudspeaker proposed by the applicant is intended to reduce the weight, and is very light as compared to conventional loudspeakers. However, there is some problem to be solved regarding the transport pallet P at the manufacturing lines Lm, Ld1, Ld2, and Ld3, because this loudspeaker has a special magnetic circuit and is extraordinary light in weight as compared to a loudspeaker having a conventional magnetic circuit. For example, during the transportation of the transport pallet P at the lines Lm, Ld1, Ld2, and Ld3, particularly at the initial stage of transportation, a loudspeaker on the transport pallet P is likely to tilt and it is difficult to correctly position the transport pallet P and the loudspeaker.

This problem also occurs for conventional loudspeakers depending upon the shape thereof, although the occurrence frequency is small. To solve this problem, a magnetic sheet P4 shown in FIG. 31 has been placed conventionally on the transport pallet P to tightly attract the yoke 4 against the transport pallet P. In this manner, a tilt of an unfinished product during the transportation of the transport pallet P has been avoided. The magnetic circuit has a large weight ratio relative to the total weight of the loudspeaker so that it functions as a good weight balancer, enhancing the above effects.

This weight balance effects of a conventional magnetic circuit are small in the case of a repulsion magnetic circuit type loudspeaker because it is very compact and light as compared to a loudspeaker having a conventional magnetic circuit. In addition, different from a conventional loudspeaker, the magnetic circuit is mounted at the bottom of the speaker frame 2 so that as shown in FIG. 31, the speaker frame 2 is placed on the transport pallet P, being raised by the bottom of the support shaft Mp. As a result, the loudspeaker is placed on the pallet P in a very unstable state as compared to a conventional loudspeaker.

The magnetic circuit of a repulsion magnetic circuit type loudspeaker is mounted at the inside of the speaker frame 2 or on the support shaft. Therefore, if the speaker frame 2 or support shaft Mp is made of resin or aluminum in order to reduce the weight thereof, the attachment strength is weak and a necessary strength cannot be obtained, because the magnetic material of the yoke 4 does not directly contact the magnetic sheet P4 as in the case of a conventional magnetic circuit. Accordingly, during the transportation of the transport pallet P, the magnetic circuit tilts more greatly. In order to solve this problem, a speaker frame 2 may be an iron speaker frame most often used conventionally. However, this approach is contradictory to reduce the weight.

On the side of the manufacturing processes, a repulsion magnetic circuit type loudspeaker has a magnetic circuit considerably light as compared to a conventional magnetic circuit, and the speaker frame and other components are also reduced in weight. Accordingly, the total weight of the repulsion magnetic circuit type loudspeaker is very light as compared to a conventional loudspeaker. In the case of a repulsion magnetic circuit type loudspeaker proposed by the applicant, it has a weight reduced by 80% or more of a conventional loudspeaker weight. With such a loudspeaker, even if the transport pallet P rotates at the coating station Sa, the loudspeaker dose not provide a friction force required for following the rotation of the transport pallet P. Specifically, even if the transport pallet P rotates 1.5 to 2 times, the unfinished loudspeaker product slips on the transport pallet P and rotates only about 0.3 to 0.7 time so that a proper adhesive coating is unable. In order to solve this, the rotation time period may be elongated until the unfinished loudspeaker product reliably follows the rotation of the transport pallet after the slip state thereof, or the rotation speed is lowered to allow the unfinished loudspeaker product to follow the rotation of the transport pallet P starting from the initial stage of rotation. However, these approaches lower the production efficiency greater than a conventional production efficiency.

SUMMARY OF THE INVENTION

It is a first object of the present invention to provide a repulsion magnetic circuit type loudspeaker which is compact and easy to assemble.

It is a second object of the present invention to provide a manufacturing method capable of easily manufacturing a repulsion magnetic circuit type loudspeaker by using a conventional manufacturing line of general loudspeakers, and to provide a manufacturing apparatus used for performing the manufacturing method.

In order to achieve the above objects of the present invention, in a repulsion magnetic circuit type loudspeaker of the invention, one of the contact plates between the magnet and the center plate is formed with a first concave or a first convex portion, the other of the contact plates is formed with a second convex or a second concave portion corresponding to the first concave or the first convex portion, and position alignment between the magnet and the center plate is achieved by engaging the first concave or the first convex portion with the second convex or the second concave portion.

A first coupling member of either a first concave or a first convex is formed on a plane defining the magnet such as an external periphery, a bottom, and a top of the magnet, a second coupling member of either a second concave or a second convex corresponding to the first coupling member or a coupling hole corresponding to the first convex is formed at a speaker frame for mounting thereon the magnetic circuit, and position alignment between the magnet and the speaker frame is achieved by engaging the first coupling member with the second coupling member.

In a method of manufacturing a loudspeaker of the invention, the magnetic circuit is assembled by using the magnets magnetized in advance. Basically, the magnetic circuit is assembled by using as a reference guide the outer periphery of the magnet or the center plate, and by engaging the coupling member of the magnet with the coupling member of the speaker frame. In mounting the magnetic circuit on a speaker frame, position alignment is achieved by engaging the concave or convex of the magnet with the convex, concave, or hole of the speaker frame. After mounting the magnetic circuit on the speaker frame, the vibrating system is assembled.

In assembling the magnetic circuit, a magnetic circuit assembly jig formed with a hole having a size matching the outer periphery of the center plate is disposed at a predetermined position of the bottom of a speaker frame, and the magnetic circuit is assembled by inserting the magnet and the center plate into the hole of the jig to simultaneously mount the magnetic circuit on the speaker frame.

In this case, a plurality of pins are mounted at predetermined positions of a loudspeaker assembly transport pallet, holes corresponding to the pins are formed in the bottom of a speaker frame and in the magnetic circuit assembly jig, and the magnetic circuit is assembled by inserting the pins into the holes of the speaker frame and the jig.

In assembling the magnetic circuit, a magnetic chuck is attached to the tip of a loading unit, the direction of generating a magnetic field of the magnet chuck is set to a direction opposite to the magnetic field direction of the magnet, and the center plate is attached by the magnet chuck for the assembly and transportation of the magnetic circuit.

A magnetic material member is mounted on the loudspeaker transport pallet, and the magnetic material member is magnetized in the same direction as the magnetizing direction of a lower one of the two magnets of the magnetic circuit.

The lower magnet magnetized in the thickness direction is fitted in a jig. Adhesive agent is coated to the magnet, and the center plate attached by the magnet chuck at the tip of the loading unit is transported to the magnet and bonded to it. Adhesive agent is coated to the top of the center plate to attach the upper magnet thereto. In this manner, the magnetic circuit is structured. In this case, the coupling member such as a convex and a concave of the magnet is engaged with the coupling member of the center plate to achieve a correct position alignment.

By engaging the concave or convex of the lower magnet with the convex, concave, or hole formed at the bottom of the speaker frame, the magnetic circuit is mounted on the speaker frame. At the next process, the vibrating system is assembled.

In the above manufacturing processes, the transport pallet is used. The magnetic circuit is fixed to the speaker frame by inserting the pin of the transport pallet via the hole of the speaker frame into the hole of the jig. A magnetized magnetic material member is attached to the transport pallet so that the lower magnet is attracted by the magnetic material and the unfinished loudspeaker product on the transport pallet can be stably held in position.

In the above manner, position alignment of the transport pallet and the unfinished loudspeaker product can be achieved like the conventional method, and the posture stability of the unfinished loudspeaker product on the transport pallet can be ensured. A conventional vibrating system assembly line can be used without any modification by adding some of the magnetic circuit assembly lines and scarcely changing the assembly work.

A manufactured repulsion magnetic circuit type loudspeaker has a structure that a mount hole or the like is not required to be formed in the magnets for the mount of the magnetic circuit on the speaker frame. It is therefore possible to manufacture a compact loudspeaker.

DETAILED DESCRIPTION OF THE PREFERRED EMBODIMENTS

Figure 1:
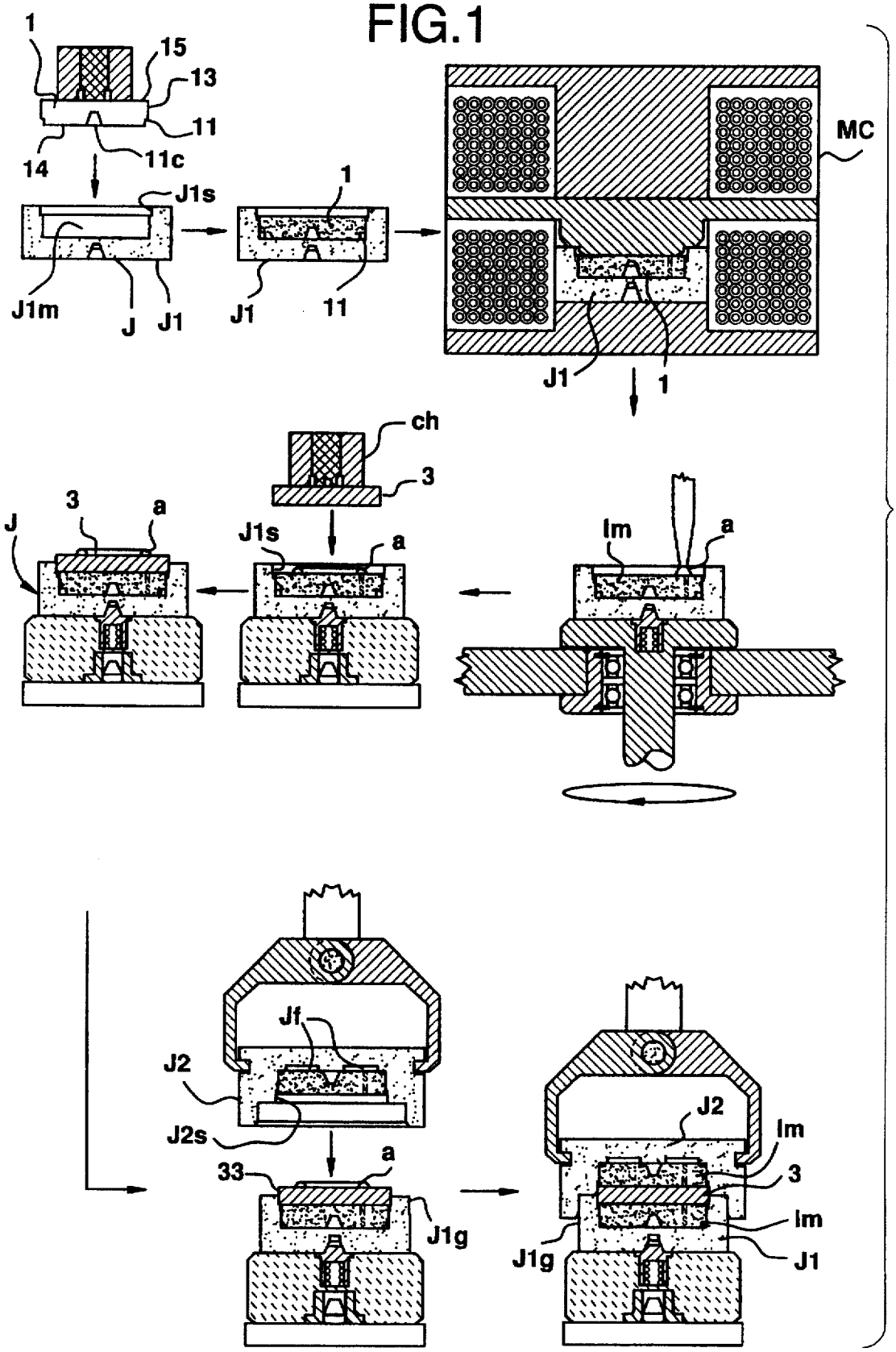
FIG. 1 is a cross sectional view explaining the processes of assembling a repulsion magnetic circuit in accordance with a loudspeaker manufacturing method of the present invention.

The embodiments of the present invention will be described with reference to FIGS. 1 to 15. Like elements to a conventional loudspeaker and a repulsion magnetic circuit type loudspeaker proposed by the present applicant, are represented by identical reference numerals and the description thereof is omitted.

In the first embodiment shown in FIGS. 1 to 4, a magnet 1 made of neodymium has an outer diameter of 29 mm and a thickness of 6 mm. A recess 11 having a depth of 1.5 mm and a width of 1.5 mm is formed at the outer periphery 13 of a magnet bottom 14. A center guide hole 11c having a conical shape of 6 mm at 60° is formed in the bottom 14 at the center thereof. The magnets 1 are inserted into a lower jig J1 and an upper jig J2. The jigs J1 and J2 are made of machined polyacetal resin, and as shown in FIG. 1, each having a magnet insertion area J1m (diameter of 29.12 mm, +0.03 mm, −0 mm) and a center plate insertion area J1s. The magnets 1 are inserted into the magnet insertion areas J1m.

The jigs J1 and J2 also function as a magnetizing jig. The jigs are inserted into magnetizing coils MC and the magnets are magnetized in the thickness direction so as to have an S pole at the bottom and an N pole at the top. The magnetized magnets are transported to an adhesive agent coating line to coat adhesive agent a on the upper surface of the magnet 1 inserted into the lower jig J1. In FIG. 1, the magnetized magnets are represented by 1m. The adhesive agent is acrylate based resin generally used heretofore. A center plate 3 is placed on the top of the magnet 1m. In this case, a loading unit of a simple structure is used. A magnet chuck ch is mounted at the tip of the loading unit. The center plate 3 is attracted by the magnet chuck ch. The direction of the magnetic field of the magnet chuck ch is opposite to that of the magnet 1m so that a force of lowering the magnet is generated while the center plate 3 is lowered from the upper space of the magnet 1m. As a result, the center plate 3 is attracted by the force of the magnet 1m, preventing the magnet 1m from being dismounted from the jig J1.

The center plate 3 is made of iron and has an outer diameter of 30.05 mm and a thickness of 4 mm. The center plate 3 is placed at the center plate insertion area J1s above the magnet insertion area Jm, the center plate insertion area J1s forming a step having a diameter of 30.07 mm and a depth of 3 mm. As shown in FIG. 1, a predetermined amount of adhesive agent a is coated on the surface of the center plate at a predetermined area. While the magnet 1m inserted in the upper jig J2 is rotated by 180°, the upper jig 1m is fitted on the lower jig J1 by using as the guide the outer periphery 33 of the center plate 3 projecting 2 mm from the lower jig J1 or the outer periphery J1g of the lower jig J1. A thin iron plate Jf has been mounted on the bottom of the magnet insertion area J2m of the upper jig J2 as shown in FIG. 1. Therefore, the magnetized magnet 1m inserted into the jig J2 is attracted to the iron plate Jf and will not fall down from the jig J2 even if the jig J2 is rotated by 180°. In this embodiment, the upper jig J2 is fitted about the outer periphery J1g of the lower jig. However, the upper and lower jigs may be formed to have the same structure. In this case, the center plate outer periphery 33 is used as the guide and adhesive agent is coated to the surfaces of only the magnets 1m.

If the thickness of the center plate 3 of the repulsion magnetic circuit is too thin, the center plate 3 receives a too excessively saturated magnetic state so that the confronting magnet 1m is repulsed by the center plate 3 and is moved away. However, if the thickness of the center plate 3 is set properly to have a state immediately before a magnetic saturation, the magnetic efficiency can be improved. In such a case, as the magnet 1m is lowered to the center plate 3 with the centers of the confronting surface of the repulsing magnet 1m and the center plate 3 being aligned, the repulsion force becomes strong when the magnet 1m is lowered greater than a predetermined distance toward the center plate 3. As the magnet 1m is further lowered and comes to the position immediately before the magnet 1m and center plate 3 attach, the repulsion force becomes weak and contrarily they attach together. As the upper jig J2 is fitted on the lower jig J1, the upper half of the center plate 3 placed on the lower jig J1 is inserted into the center plate insertion area J2s of the upper jig J2, and the repulsion magnetic circuit is structured. This magnetic circuit is maintained under this condition for a predetermined time to make the adhesive agent a cure and bond the center plate 3 and the magnets 1m together to complete the assembly of the magnetic circuit.

Figure 2:
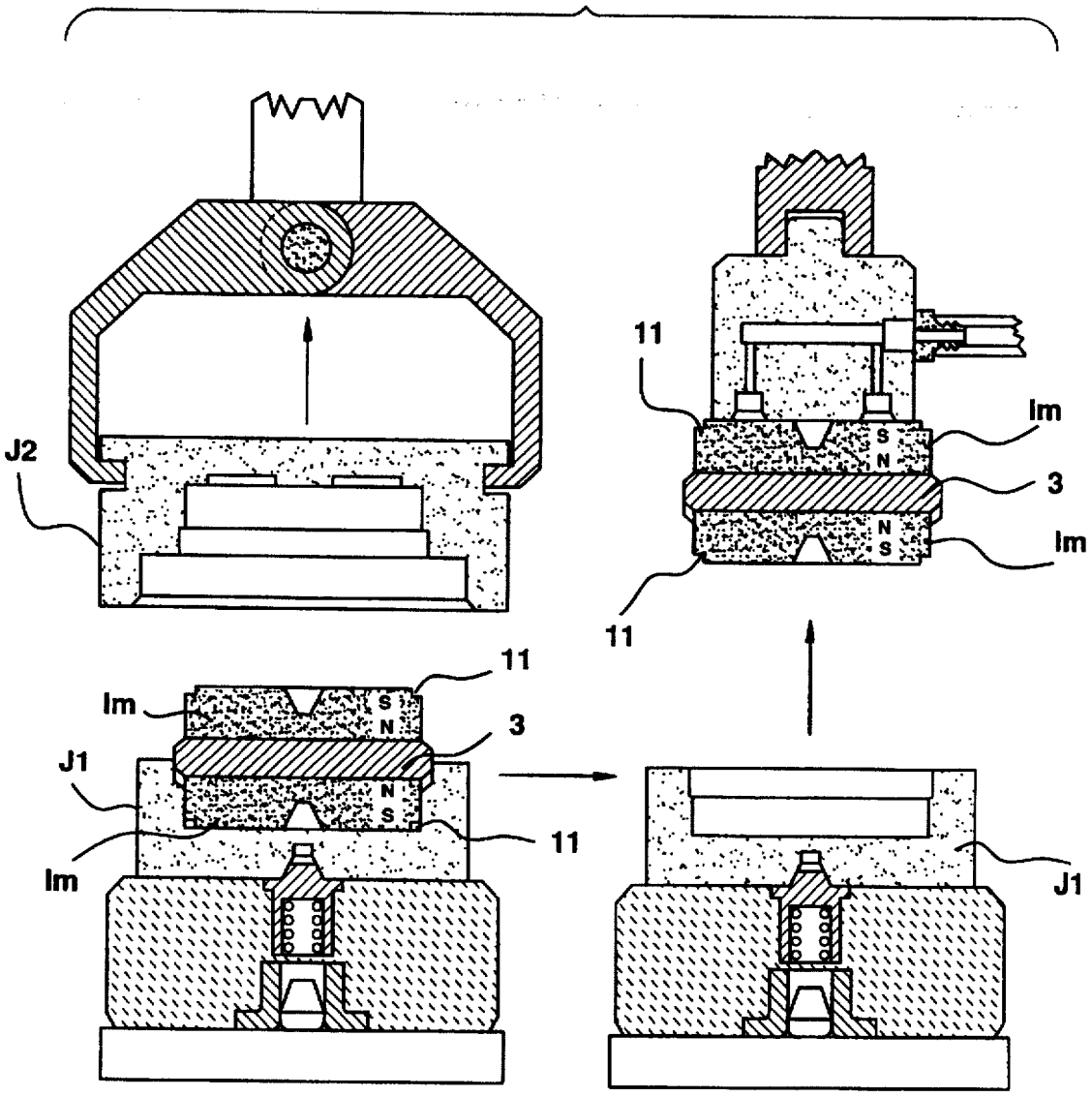
FIG. 2 is a cross sectional view explaining the process of picking up the repulsion magnetic circuit shown in FIG. 1.
Figure 3A:
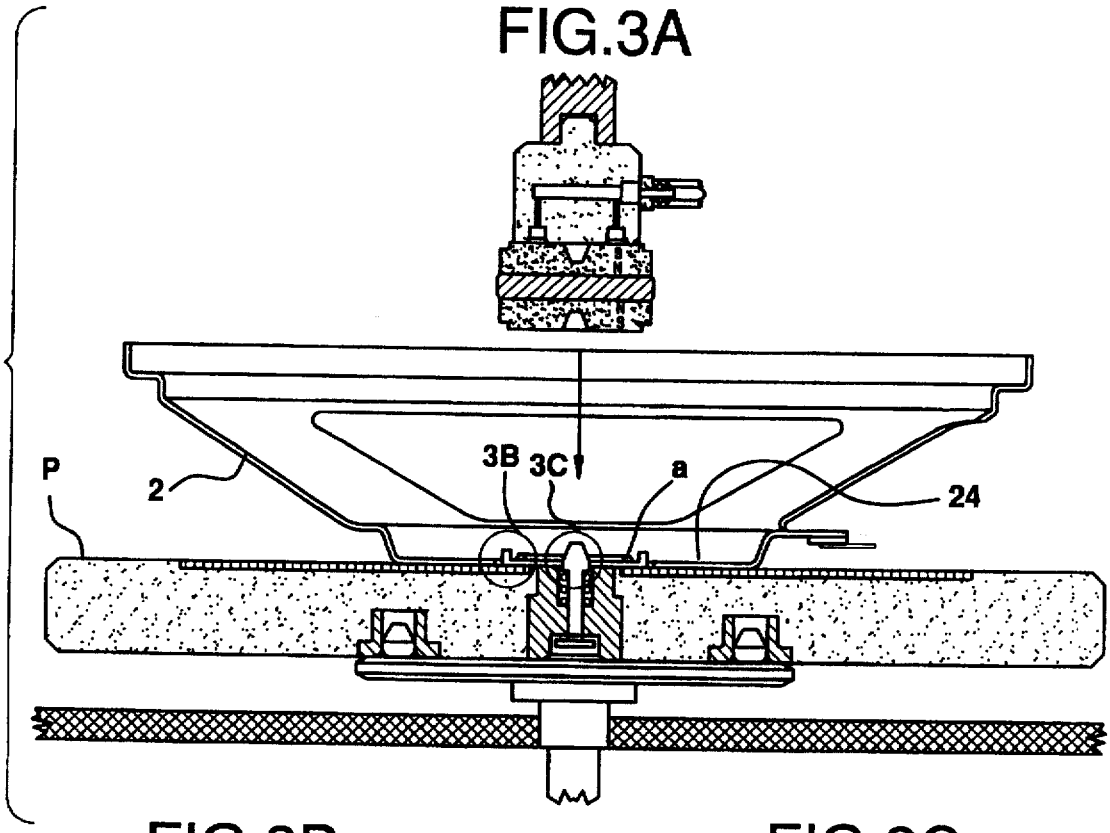
FIGS. 3A–3C are cross sectional views explaining the process of mounting the repulsion magnetic circuit on a speaker frame.
Figure 3B:
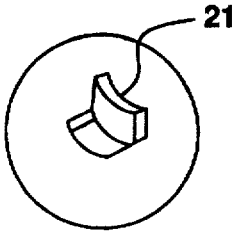
Figure 3C:
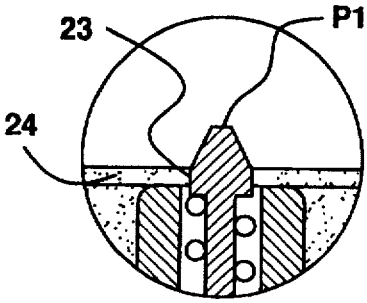
Figure 4:
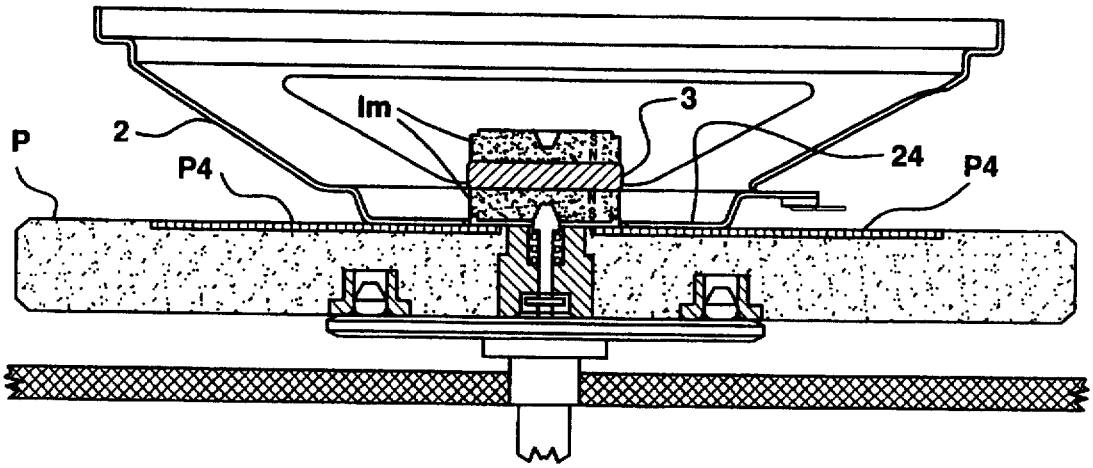
FIG. 4 is a cross sectional view showing the mount state of the repulsion magnetic circuit on a speaker frame.

Next, as shown in FIG. 2, the upper jig J2 is dismounted from the lower jig J1, and the repulsion magnetic circuit is picked up and transported to the place where a speaker frame 2 is located as shown in FIGS. 3 and 4. The speaker frame 2 is made of a pressed aluminum plate having a thickness of 0.7 mm. As shown in the partial enlarged view in FIG. 3, a positioning hole 23 is formed at the center of the bottom 24 of the speaker frame 2. The positioning hole 23 has a diameter of 6.1 mm matching the center guide pin P1 formed at the center of a transport pallet P. As shown in another partial enlarged view in FIG. 3, a projection 21 having a height of 1.3 mm and a width of 3 mm is formed at the radial position spaced from the center of the bottom 24 by 26.2 mm. The speaker frame 2 is placed on the transport pallet P with the center guide pin P1 formed at the center of the transport pallet P being inserted into the positioning hole 23. Under this mount state, the vertical portion of the center guide pin P1 engages with the vertical portion of the positioning hole 23. Therefore, the speaker frame 2 will not tilt during the transportation of the transport pallet P and maintains a correct position.

In order to fix the repulsion magnetic circuit to a predetermined position of the bottom 24 of the speaker frame 2, adhesive agent a is coated. In coating the adhesive agent, a conventional nozzle moving coating method is used. There is therefore no problem of slippage of a speaker frame, as described earlier, associated with a transport pallet rotating coating method. It is possible therefore to coat adhesive agent to the predetermined area of the speaker frame 2. After the adhesive agent is coated, the repulsion magnetic circuit is transported by a loading unit to the speaker frame 2. The center guide pin P1 of the transport pallet P engages with the center guide hole 11c formed in the bottom 14 of the magnet so that the magnetic circuit, speaker frame 2, and transport pallet P can be aligned in position. Furthermore, the projection 21 formed on the bottom 24 of the speaker frame 2 engages with the recess 11 at the outer periphery 13 of the bottom 14 of the magnet. Accordingly, even if a strong lateral force is applied to the magnetic circuit, this circuit will not be moved greatly. Even if it is moved, this displacement is within a clearance set by the dimensions of the recess 11 of the magnet 1 and the projection 21. A displacement within this clearance does not hinder the manufacture of the loudspeaker.

Conventionally, the direction of magnetizing a rubber magnet sheet P4 placed on the transport pallet P has been arbitrary because the yoke 4 and the like in contact with the magnet sheet is made of magnetic material. In this embodiment, however, the magnet sheet P4 is magnetized in the same direction as the lower magnet 1m of the repulsion magnetic circuit. Accordingly, magnetic fluxes pass through the lower magnet 1m of the magnetic circuit and the magnet sheet P4 of the transport pallet P so that the lower magnet 1m and the magnet sheet P4 attract each other. Therefore, a force of pushing the speaker frame 2 between the lower magnet 1m and the magnet sheet P4 toward the transport pallet P is generated to hold an unfinished loudspeaker in position on the transport pallet P. During the transportation and rotation of the transport pallet P, the unfinished loudspeaker will not be displaced from the predetermined position. The unfinished loudspeaker is maintained under this condition for a predetermined time to cure the adhesive agent a and complete the mount of the magnetic circuit on the speaker frame 2.

Figure 14:
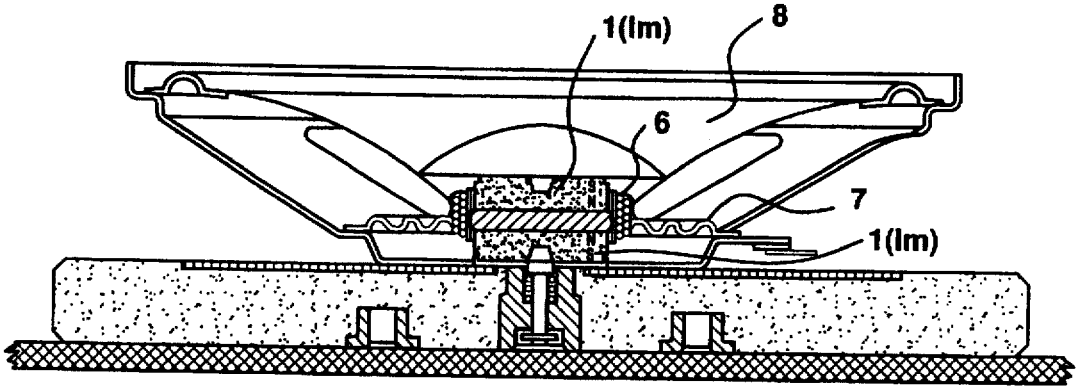
FIG. 14 is a cross sectional view showing the relationship between a finished repulsion magnetic circuit loudspeaker and a transport pallet, according to the present invention.

The unfinished loudspeaker with the magnetic circuit being mounted on the speaker frame 2 is then transported by the transport pallet P to the vibrating system assembly lines Ld1, Ld2, and Ld3 whereat vibrating system components (a voice coil 6, a damper 7, a cone diaphragm 8, and the like) are sequentially assembled to complete a loudspeaker shown in FIG. 14. These assembly methods are the same as conventional methods. The pallet transport method at the vibrating system assembly lines, i.e., the unfinished loudspeaker transport method, is the same as the conventional method. In this embodiment, however, with this method, the magnetized magnet 1m of the magnetic circuit and the magnet sheet P4 of the transport pallet P are attached each other during the transportation.

Figure 5A:
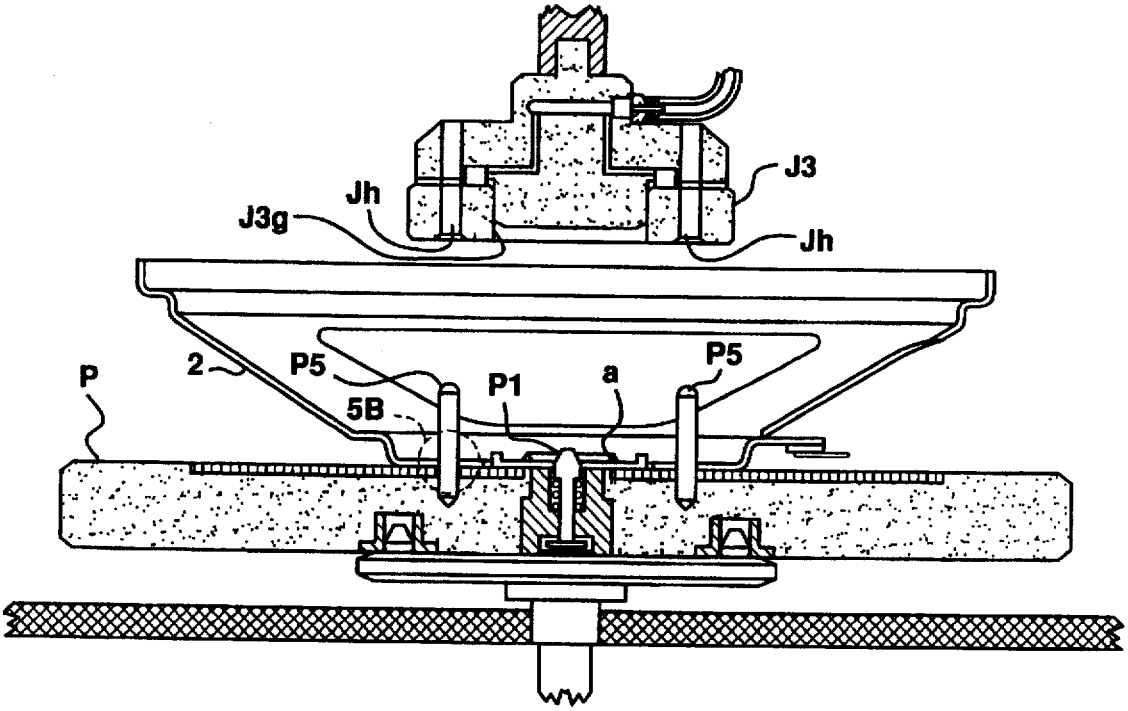
FIGS. 5A–5B are cross sectional views explaining positioning a speaker frame to a transport pallet at the assembly process of a repulsion magnetic circuit according to another embodiment of the invention.
Figure 5B:
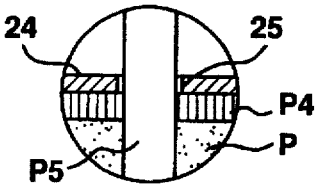
Figure 6:
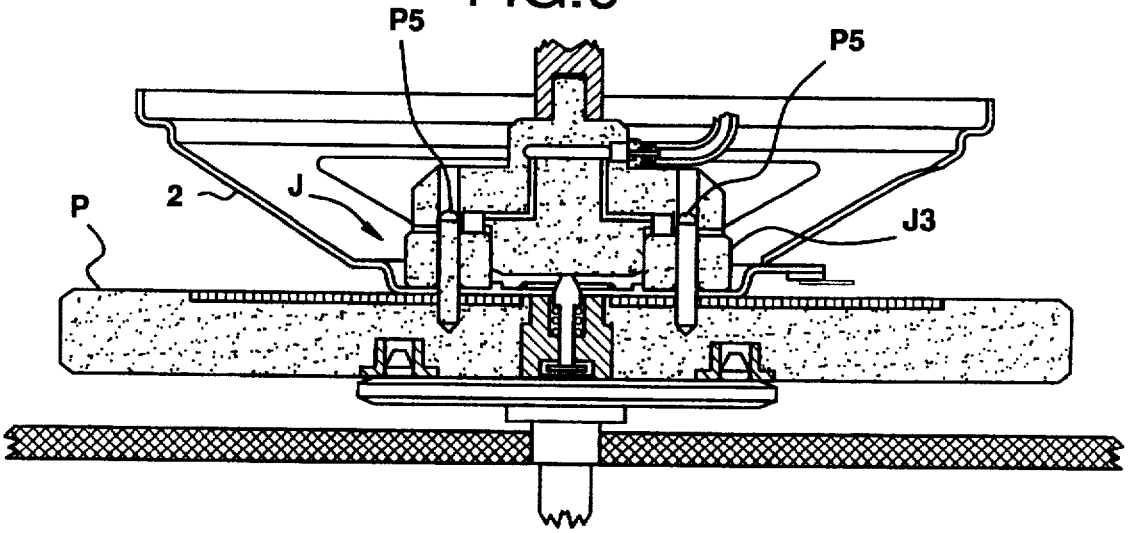
FIG. 6 is a cross sectional view explaining mounting a magnetic circuit assembly jig, as changed from the state shown in FIG. 5.
Figure 7:
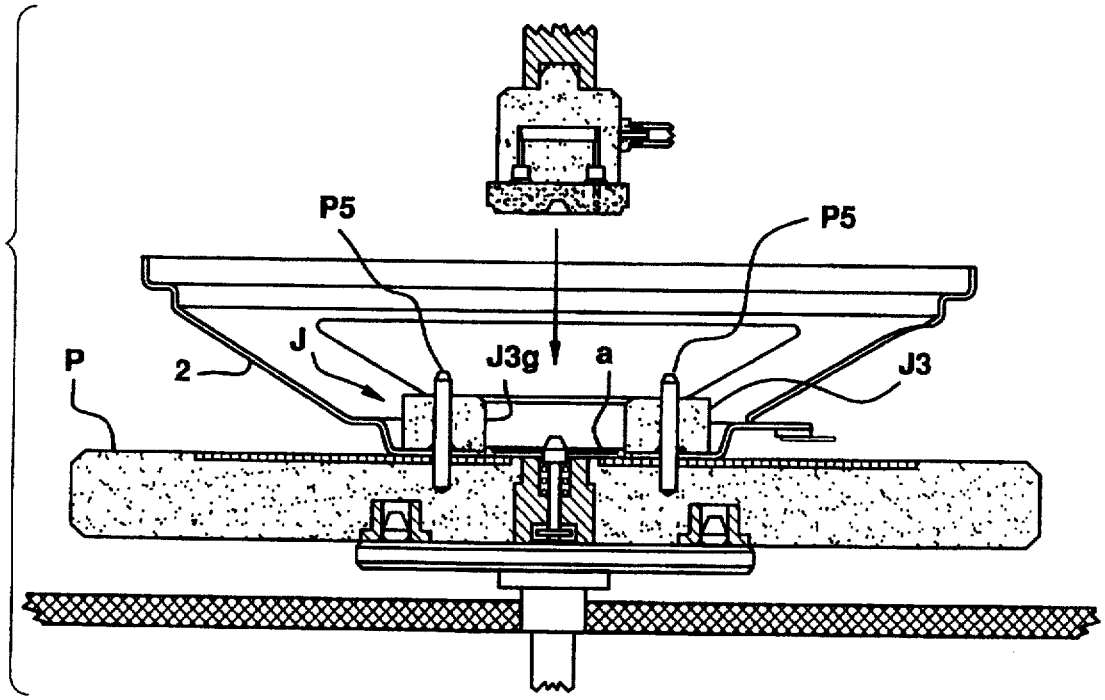
FIG. 7 is a cross sectional view explaining mounting a lower magnet, as changed from the state shown in FIG. 6.
Figure 8:
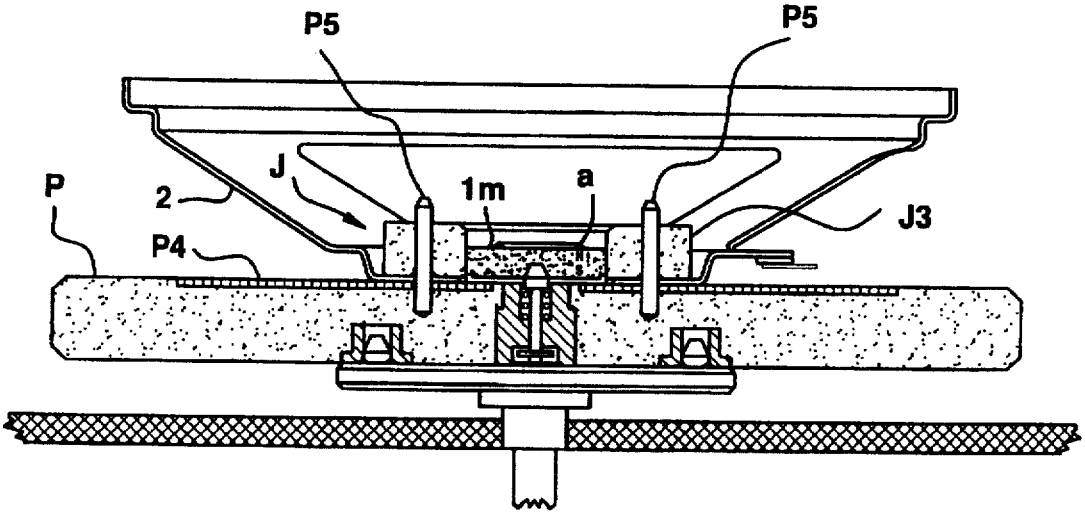
FIG. 8 is a cross sectional view showing a mount state of the lower magnet.
Figure 9:
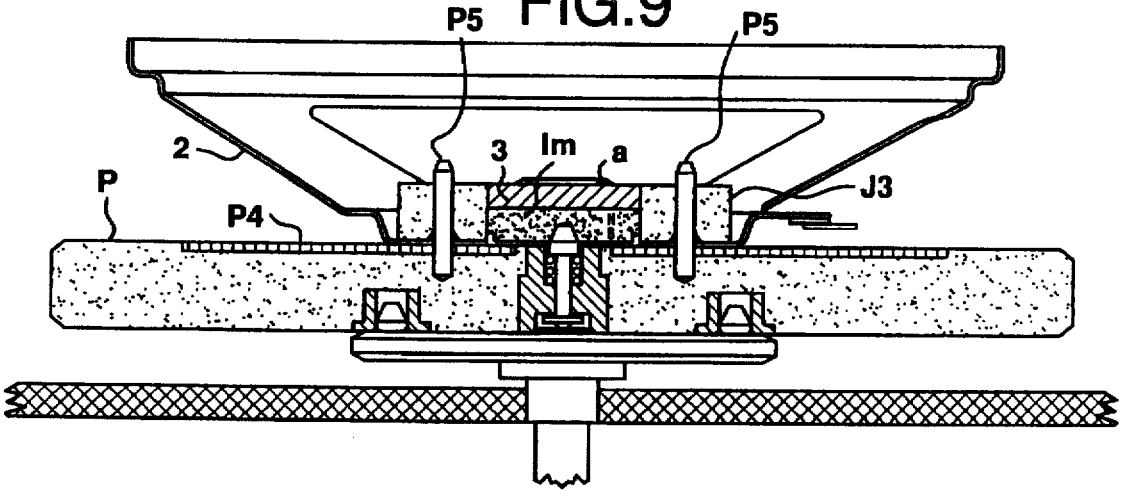
FIG. 9 is a cross sectional view showing the mount state of a center plate, as changed from the state shown in FIG. 8.

A second embodiment is shown in FIGS. 5 to 11. As shown in FIG. 5, in addition to a center guide pin P1, a plurality of pins P5 are mounted on the transport pallet at desired positions. Holes 25 corresponding to the pins P5 are formed in the frame bottom 24. As shown in the partial enlarged view in FIG. 5, the speaker frame is placed on the transport pallet P by inserting the pins P5 into the holes 25. In this embodiment, the pins P5 are distributed radially about the center line of the transport pallet at a pitch of 50 mm. Each pin P5 has a diameter of 5 mm, and each hole 25 at the frame bottom has a diameter of 5.4 mm. Magnetic circuit assembly jigs J3 and J4 are disposed as shown in FIG. 6. Similar to the jigs J1 and J2, the jig J4 is an upper jig and the jig J3 is a lower jig, and they are made of machined polyacetal resin and generally of a ring shape. Holes Jh are formed in the lower and upper jigs J3 and J4 at the positions corresponding to the positioning pins P5. The inner diameter j3g of the lower jig J3 is 30.07 mm, +0.03 mm, −0 mm so as to guide the center plate outer periphery 33.

Figure 10:
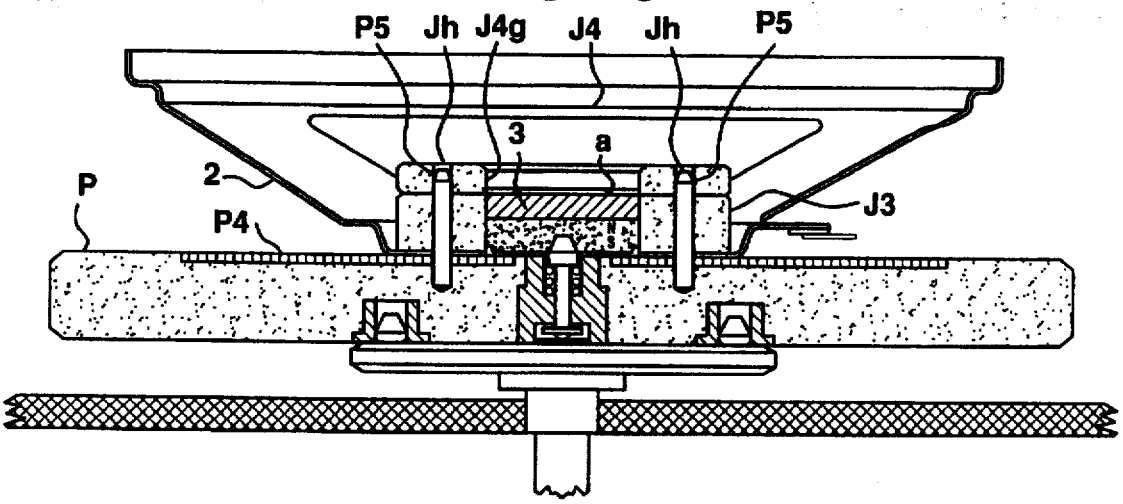
FIG. 10 is a cross sectional view explaining coating adhesive agent to the surface of the center plate, as changed from the state shown in FIG. 9.
Figure 11:
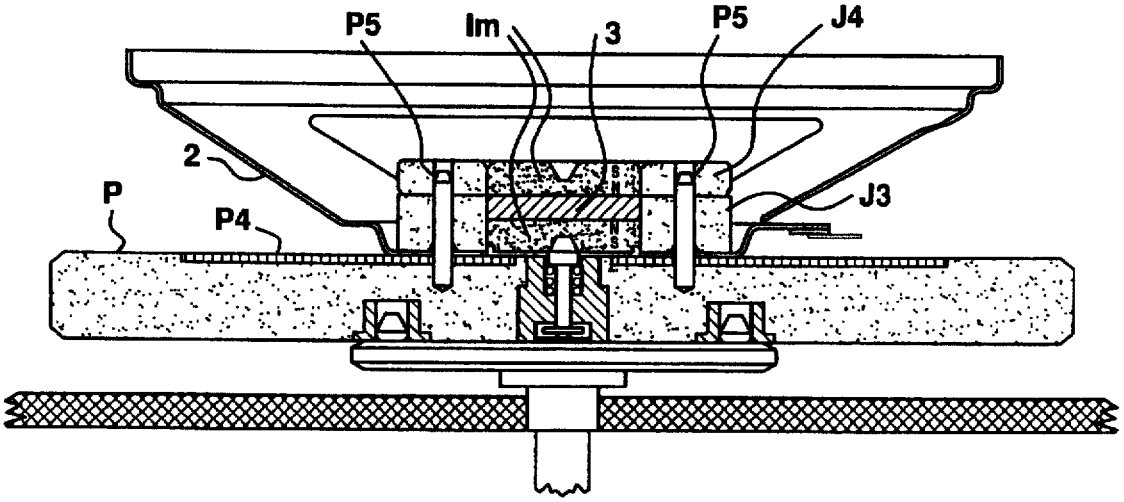
FIG. 11 is a cross sectional view showing the mount state of an upper magnet on the center plate, as changed from the state shown in FIG. 10.
Figure 12A:
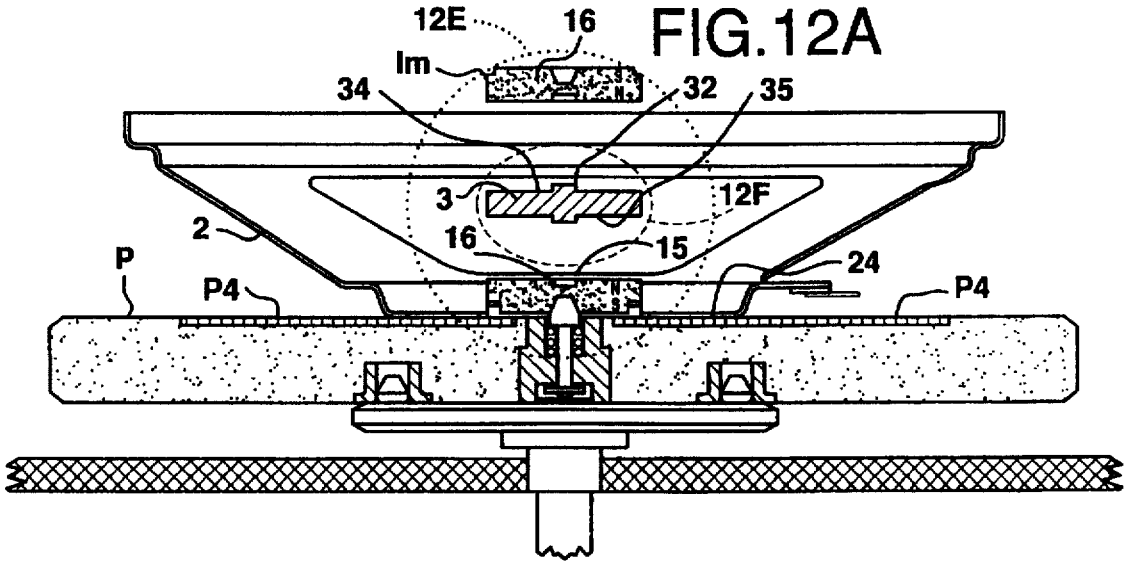
FIGS. 12(A)–(F) are cross sectional views explaining the processes of assembling a repulsion magnetic circuit and mounting the magnetic circuit on a speaker frame in accordance with another embodiment of the invention.
Figure 12B:
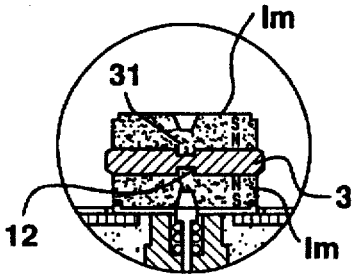
Figure 12C:
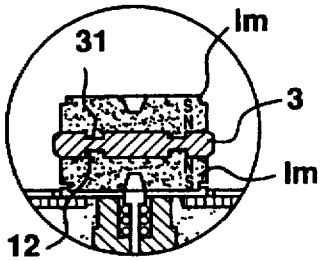
Figure 12E:
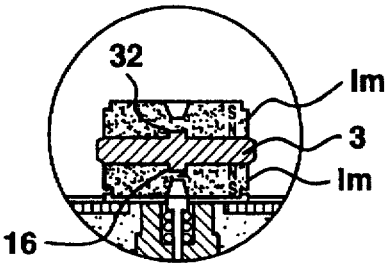
Figure 12D:
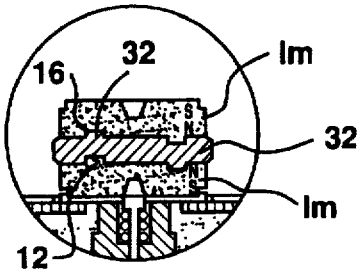
Figure 12F:
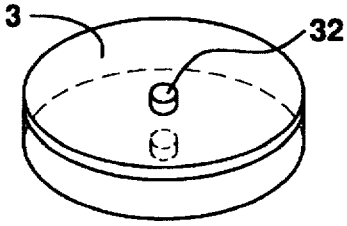

Similar to the first embodiment, adhesive agent a is coated to the bottom 24 of the speaker frame 2. As shown in FIGS. 6 to 11, the guide pins P5 are inserted into the holes Jh of the lower jig J3. A magnetized magnet 1m is aligned in position by the center guide pin P1 and the projection 21 at the frame bottom 24, and the magnetized magnet 1m is attracted to the rubber magnet P4 of the transport pallet P with the frame bottom 24 being squeezed therebetween. Adhesive agent a is coated to the top of the magnet 1m, and a center plate is placed on the magnet 1m. As shown in FIG. 10, the pins P5 are inserted into the holes Jh of the upper jig J4 to place the upper jig J4 on the lower jig J3. The inner diameter J4g of the upper jig J4 is 29.12 mm, +0.03 mm, and −0 mm so as to match the size of the outer periphery of the magnet and prevent a lateral motion of the magnet 1m on the center plate 3. Adhesive agent is coated to the top of the center plate 3, and another magnetized magnet 1m is inserted into the upper jig J4 with the N pole facing the center plate as shown in FIG. 11. The magnetic circuit with the speaker frame is maintained under this condition for a predetermined time to cure the adhesive agent a and bond the center plate 3, magnets 1m, and speaker frame 2 together. In this manner, the assembly of the repulsion magnetic circuit and the mount of the magnetic circuit on the frame 2 are completed.

After the assembly and mount have been completed in the above manner, the jigs J4 and J3 are dismounted and the unfinished loudspeaker is transported to the vibrating system assembly lines Ld1, Ld2, and Ld3 to assemble vibrating system components in the manner like the first embodiment. In this embodiment, the outer diameter of the center plate 3 is set larger than that of the magnets 1m and the two jigs J3 and J4 are used. The outer diameter of the center plate 3 may be set same as that of the magnets 1m to form a practically usable repulsion magnetic circuit. In this case, a single jig can be shared as the upper and lower jigs J3 and J4.

FIGS. 12 and 13 show a third embodiment. A coupling member of either a convex 12 or a concave 16 is formed on one surface 15 (contacting the center plate 3) of a magnet 1m at a desired position. Another coupling member of either a concave 32 or a convex 31 matching the convex 12 or concave 16 is formed on the top and bottom surfaces of the center plate 3. The two coupling members are engaged each other to align in position the repulsion magnetic circuit and assemble it. In this embodiment, as shown in FIG. 12, a concave 16 having a diameter of 3.1 mm and a depth of 1.2 mm is formed at the center of the one surface 15 of each magnet 1m. A convex 32 having a diameter of 2.9 mm and a height of 1.0 mm is formed at the center of each of the top and bottom surfaces of the center plate 3 contacting the magnets. Similar to the first embodiment, a positioning hole 23 and a projection 21 are formed at the central area of the bottom 24 of the speaker frame 2.

In this embodiment, similar to the first embodiment, the center guide pin P1 of the transport pallet P is inserted into the positioning center hole 23 of the speaker frame 2 to place the speaker frame 2 on the transport pallet P. Similar to the first embodiment, adhesive agent (not shown) is coated to the frame bottom 24, a magnetized magnet 1m is placed thereon, adhesive agent is coated to the one surface 15 of the magnet 1m, and a center plate 3 is placed thereon. In this state, the convex of 32 of the center plate 3 is inserted into the concave 16 of the magnet 1m. Adhesive agent is coated to the top surface of the center plate 3, and another magnet 1m is placed thereon by inserting the convex 32 of the center plate 3 into the concave 16 of the magnet 1m to bond them together. In this manner, the magnets 1m can be bonded without any displacement.

Figure 13A:
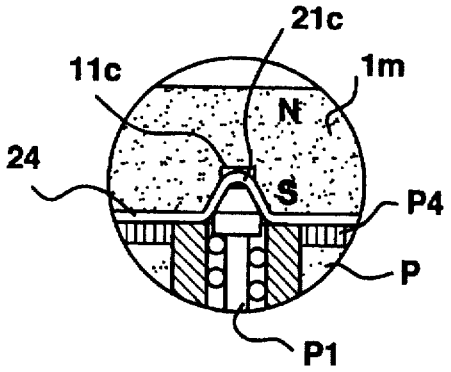
FIGS. 13(A)–(F) are partial enlarged views in section showing the mutual relation between a lower magnet, a frame bottom, and a guide pin of a transport pallet, under the mount state of the repulsion magnetic circuit on the speaker frame.
Figure 13B:
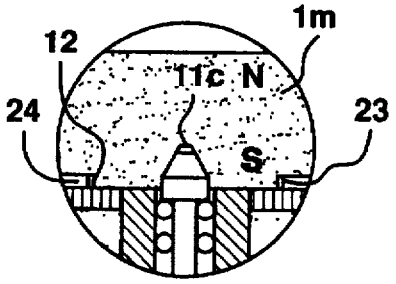
Figure 13C:
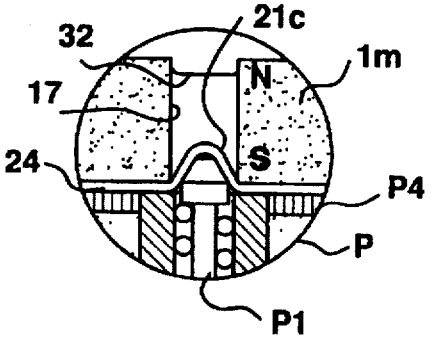
Figure 13D:
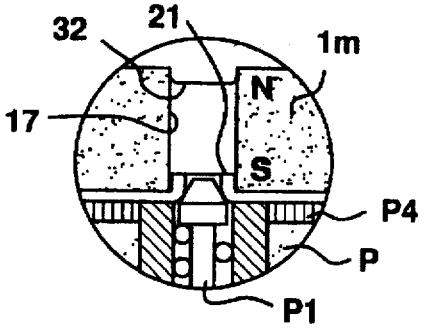
Figure 13E:
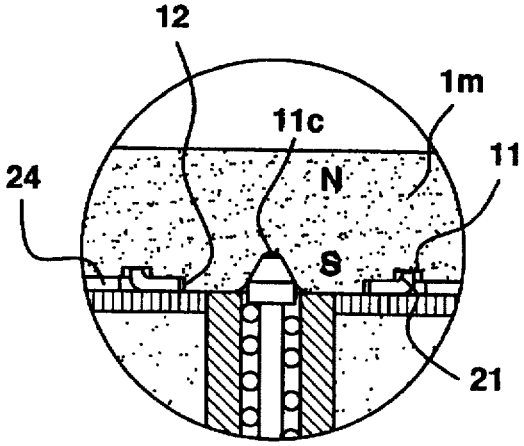
Figure 13F:
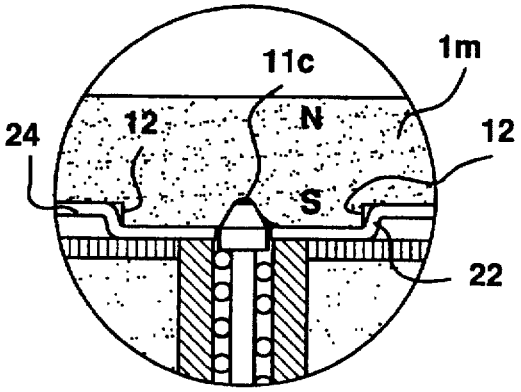

As described previously, if the thickness of the center plate 3 is proper, the magnet 1m and center plate 3 attract each other immediately before they contact each other. Therefore, unless the magnet 1 is displaced from the center too much and the magnetic balance is lost, the proper attachment between the magnet and center plate 3 can be maintained. As a result, the concave 16 of the magnet 1 and the convex 32 of the center plate 3 prevent the lateral displacement. In this embodiment, the convex 32 is formed at the center of the center plate 3. For example, a concave 31 may be formed on the center plate 3 side, and a convex 16 may be formed on the magnet 1m side to couple them together. As shown in FIG. 13, various modifications of the mount state between the magnet 1m and the frame bottom 24 may be used. As shown in FIG. 13(A), a swayed convex 21c corresponding to the center guide hole 11c of the magnet 1m may be formed at the frame bottom 24 to couple them together. If it is important to reduce the weight, as shown in FIGS. 13(C) and 13(D), a hole 17 may be formed in the magnet. In this case, the convex 21 or 21c may be inserted into this hole 17. The shape and position of the concave and convex or the member of concaves and convexes can be determined as desired. The center plate 3, magnets 1m, and frame 2 are maintained under this condition for a predetermined time to cure the adhesive agent and bond them together. In this manner, the assembly of the repulsion magnetic circuit and the mount of the magnetic circuit on the speaker frame 2 are completed. The unfinished loudspeaker is then transported to the vibrating system assembly lines Ld1, Ld2, and Ld3 to mount vibrating system components in the manner like the first embodiment. This assembly method for the repulsion magnetic circuit can be automated to the same degree as conventional magnetic circuit assembly lines for general loudspeakers.

Figure 15:
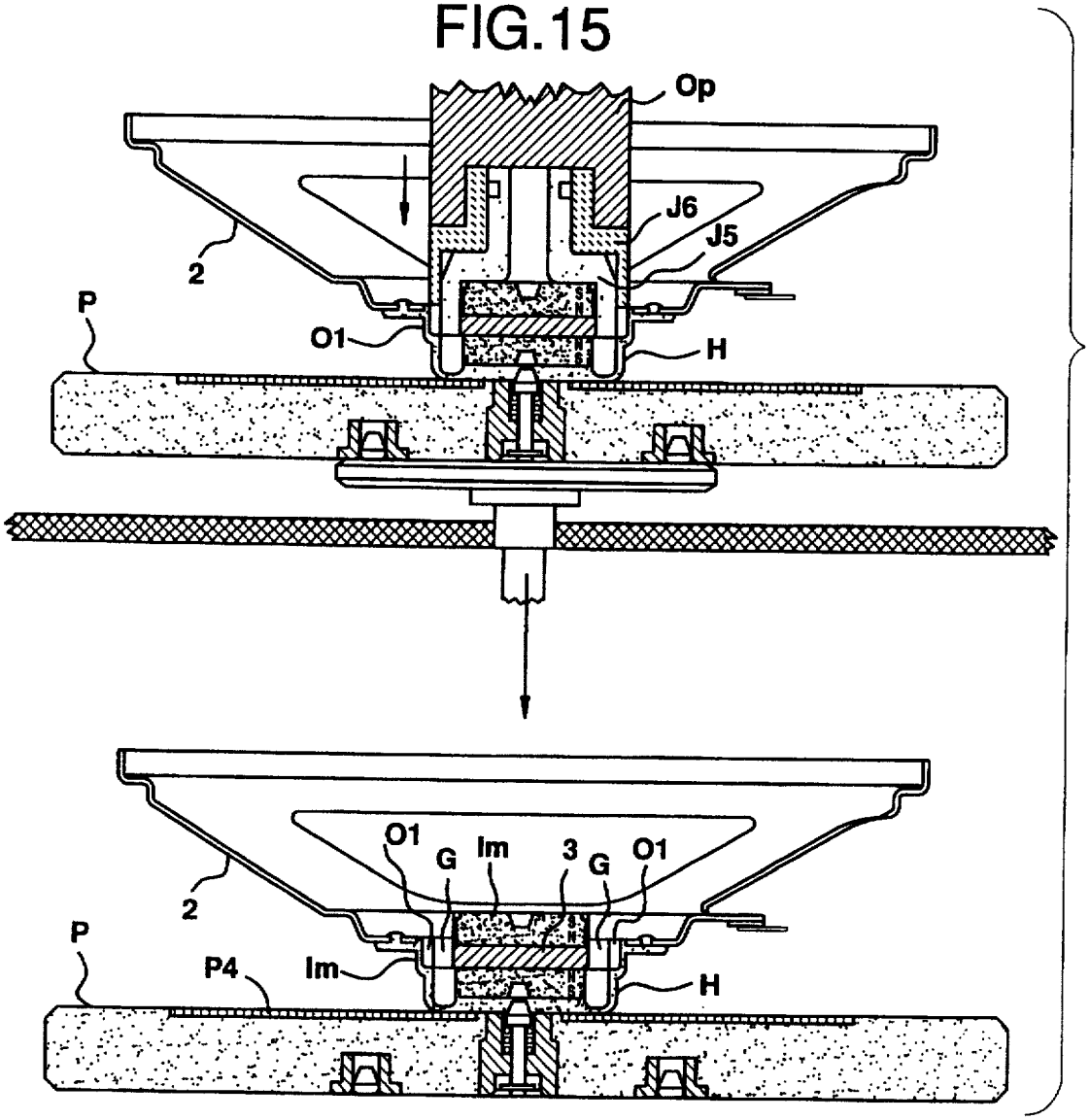
FIG. 15 is a cross sectional view showing an example of assembling a repulsion magnetic circuit type loudspeaker of the type that an outer ring is disposed on the outer side of a center plate.
Figure 16:
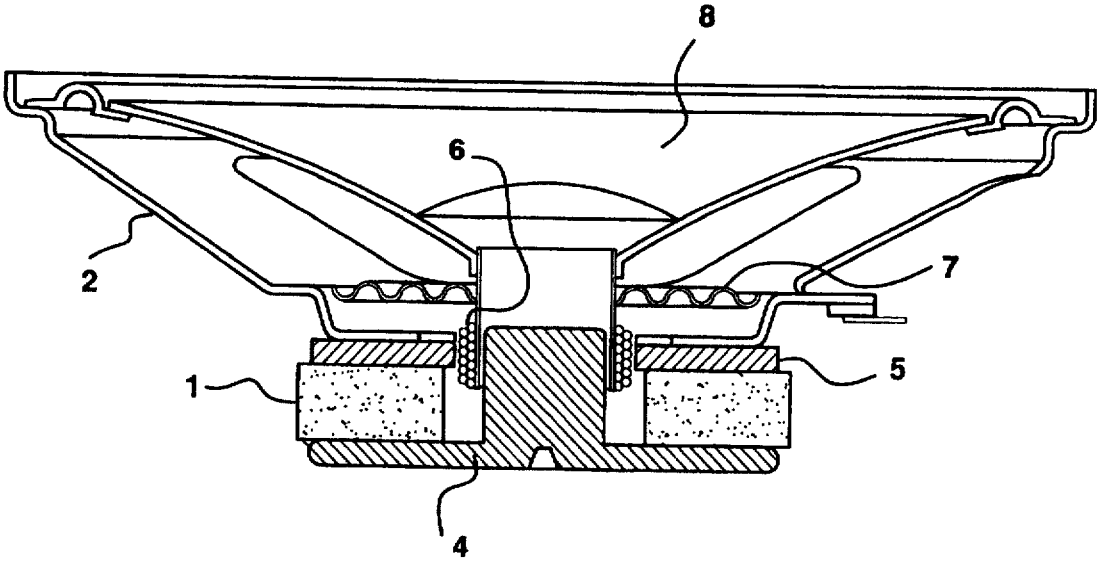
FIG. 16 is a cross sectional view of a loudspeaker having a conventional outer magnet type magnetic circuit.
Figure 17:
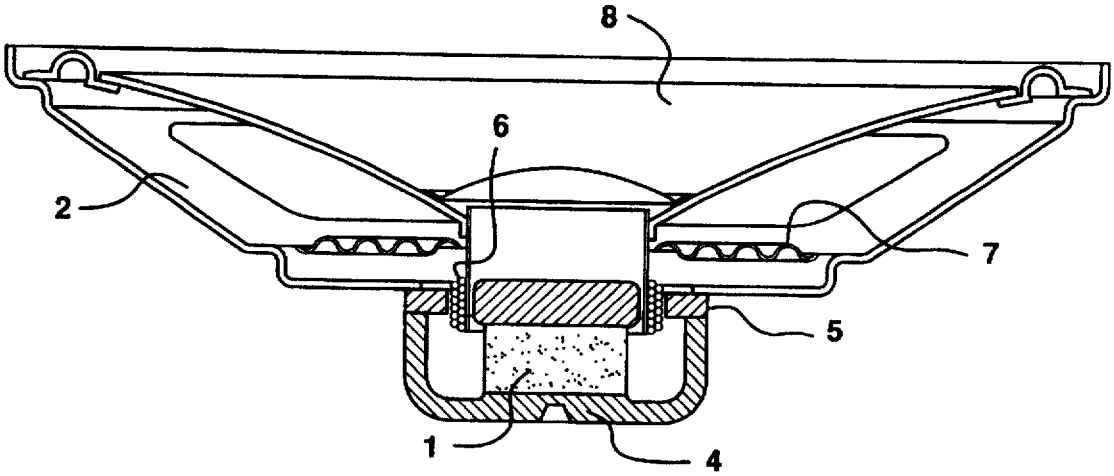
FIG. 17 is a cross sectional view of a loudspeaker having a conventional inner magnet type magnetic circuit.
Figure 18:
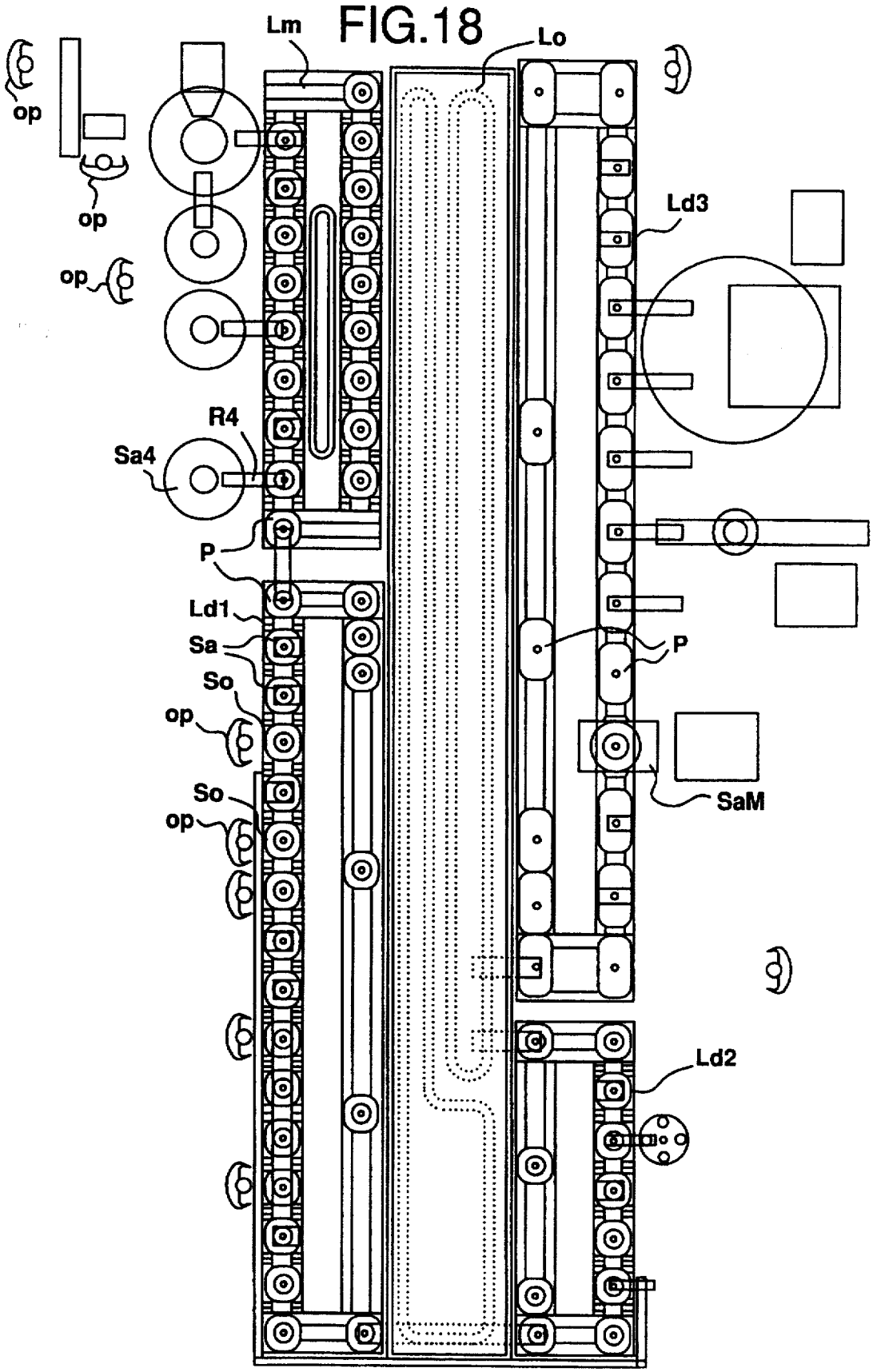
FIG. 18 is a plan view of a conventional loudspeaker manufacturing line used by the present applicant.
Figure 19:
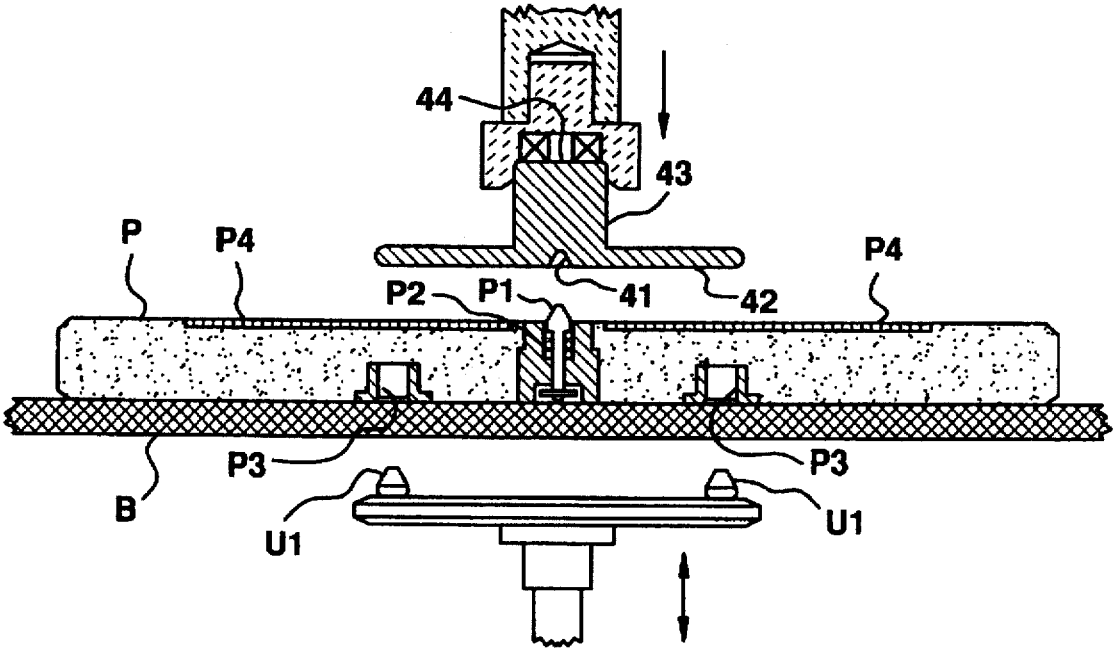
FIG. 19 is a cross sectional view explaining the structure of a transport pallet used by a conventional loudspeaker manufacturing line.
Figure 20:
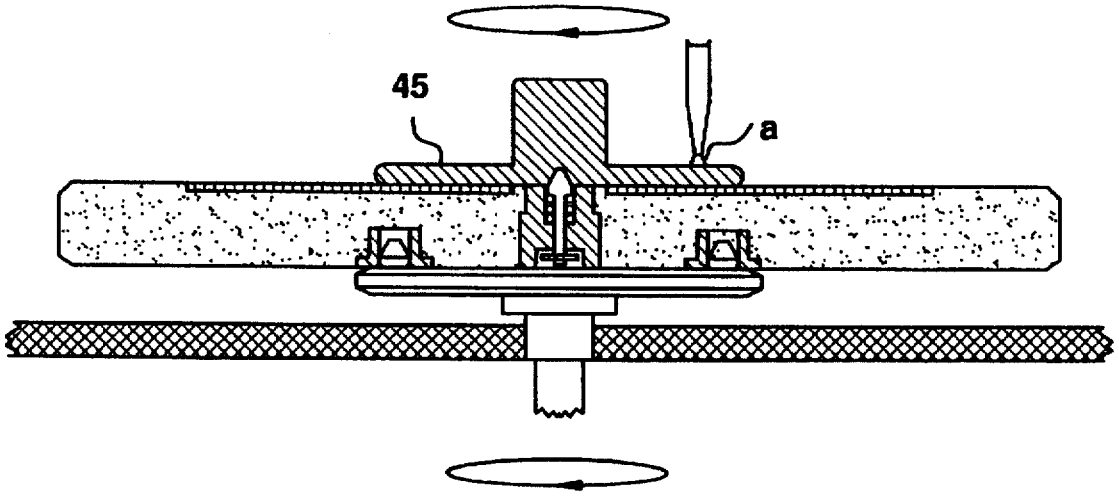
FIG. 20 is a cross sectional view showing the state of a transport pallet raised and rotated.
Figure 21:
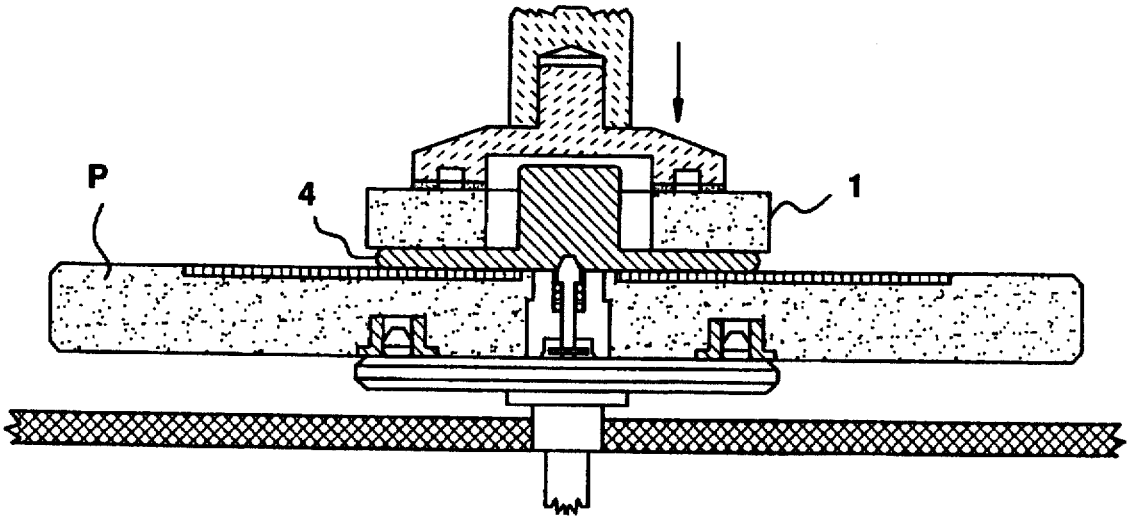
FIG. 21 is a cross sectional view showing the mount state of a magnet on a yoke.
Figure 22:
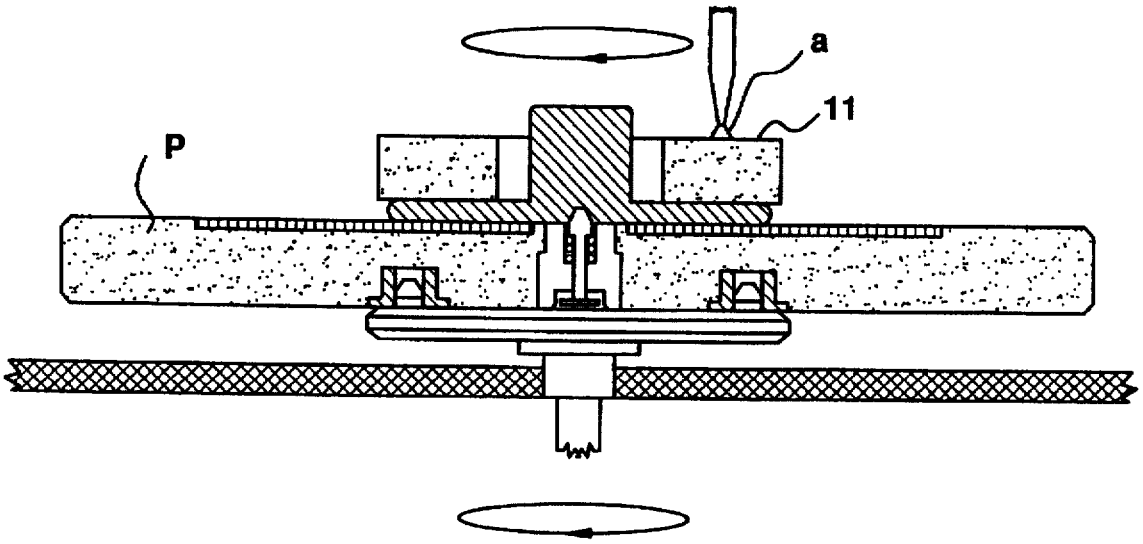
FIG. 22 is a cross sectional view showing the state of coating adhesive agent to a magnet.
Figure 23:
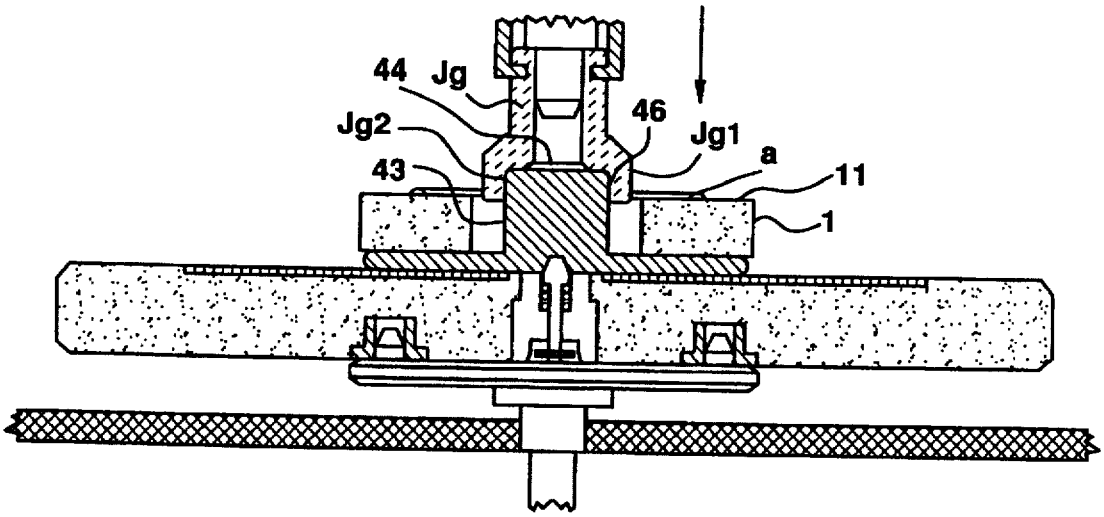
FIG. 23 is a cross sectional view explaining mounting a magnetic gap forming jig.
Figure 24:
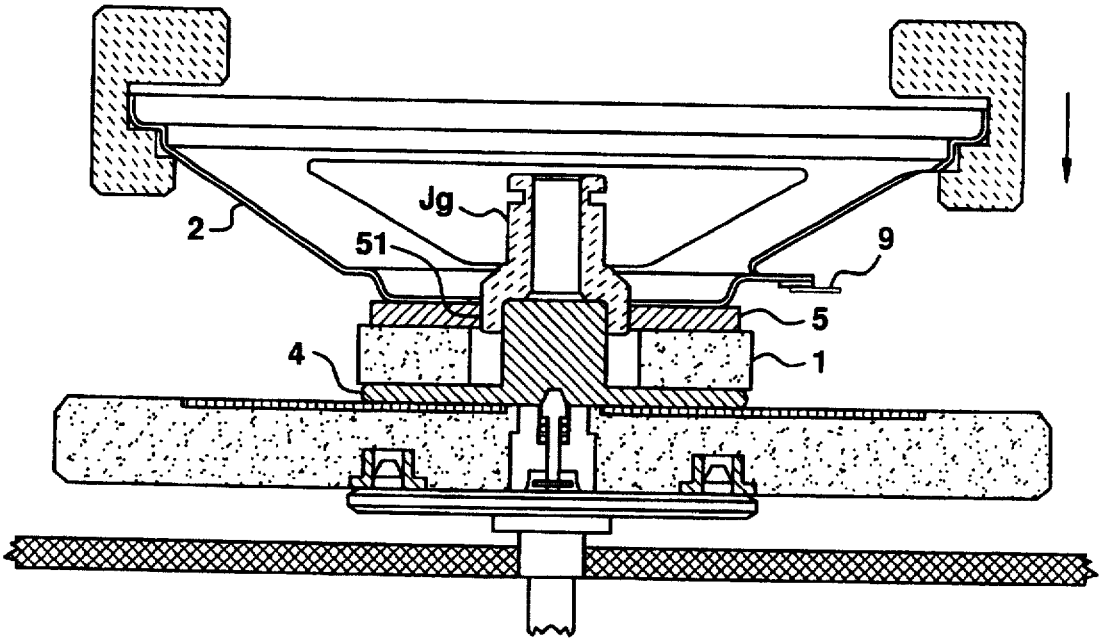
FIG. 24 is a cross sectional view showing the mount state of a top plate and explaining the process of mounting a speaker frame.
Figure 25:
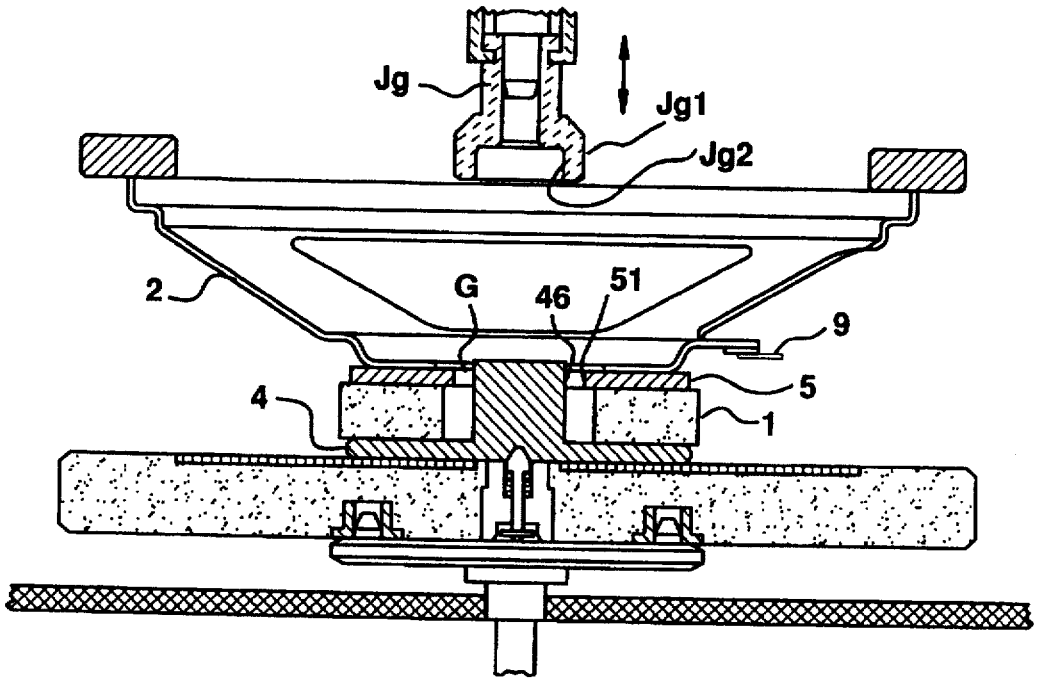
FIG. 25 is a cross sectional view showing the dismount state of the magnetic gap forming jig.
Figure 26:
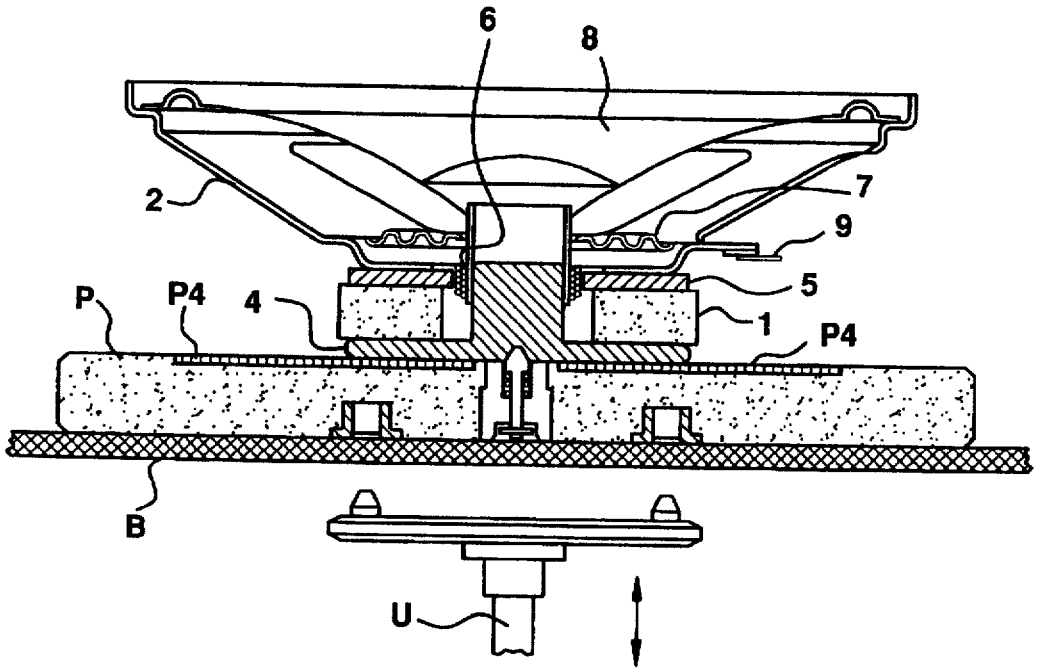
FIG. 26 is a cross sectional view showing the assemble completion state of a loudspeaker having a conventional outer magnet time magnetic circuit.
Figure 27:
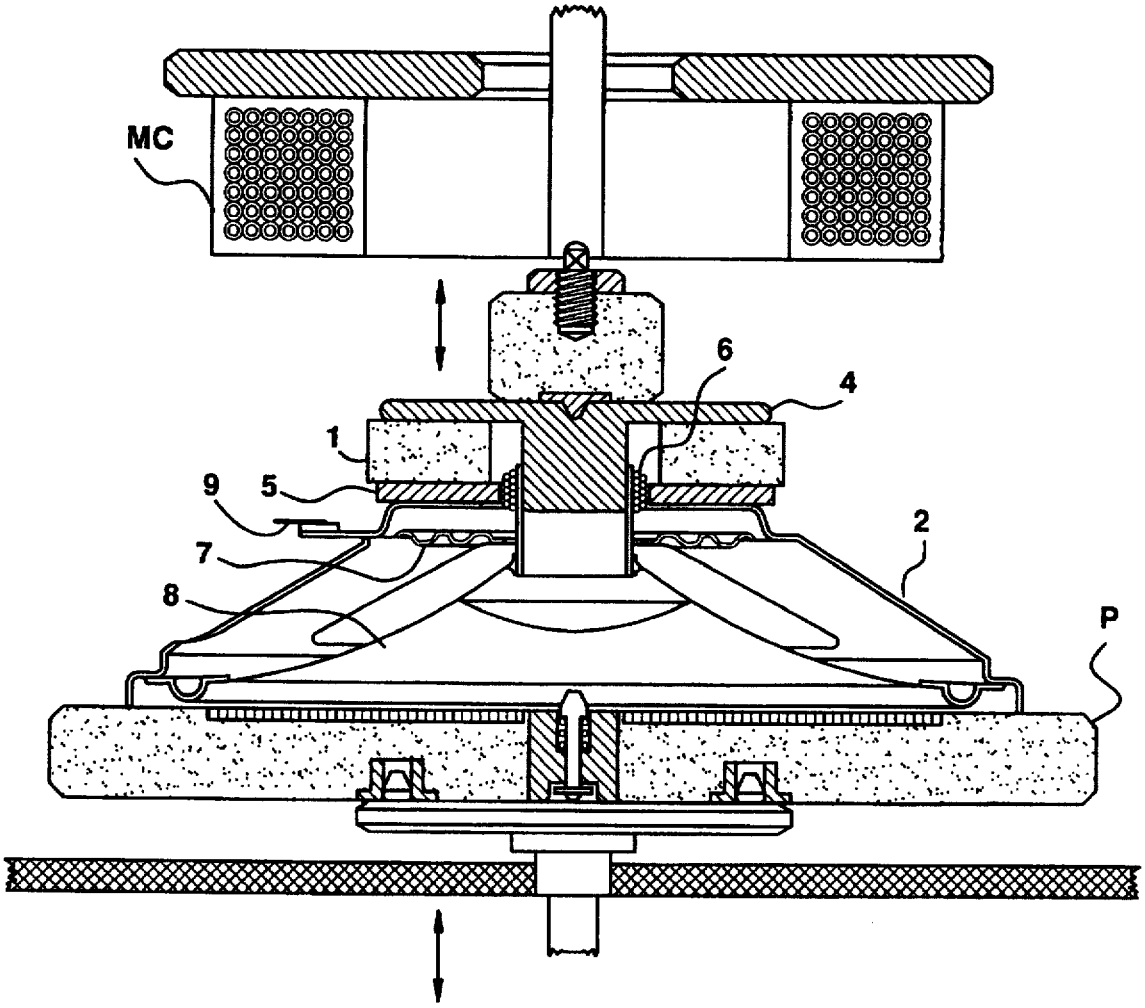
FIGS. 27 and 28 are cross sectional views explaining magnetizing a magnet.
Figure 28:
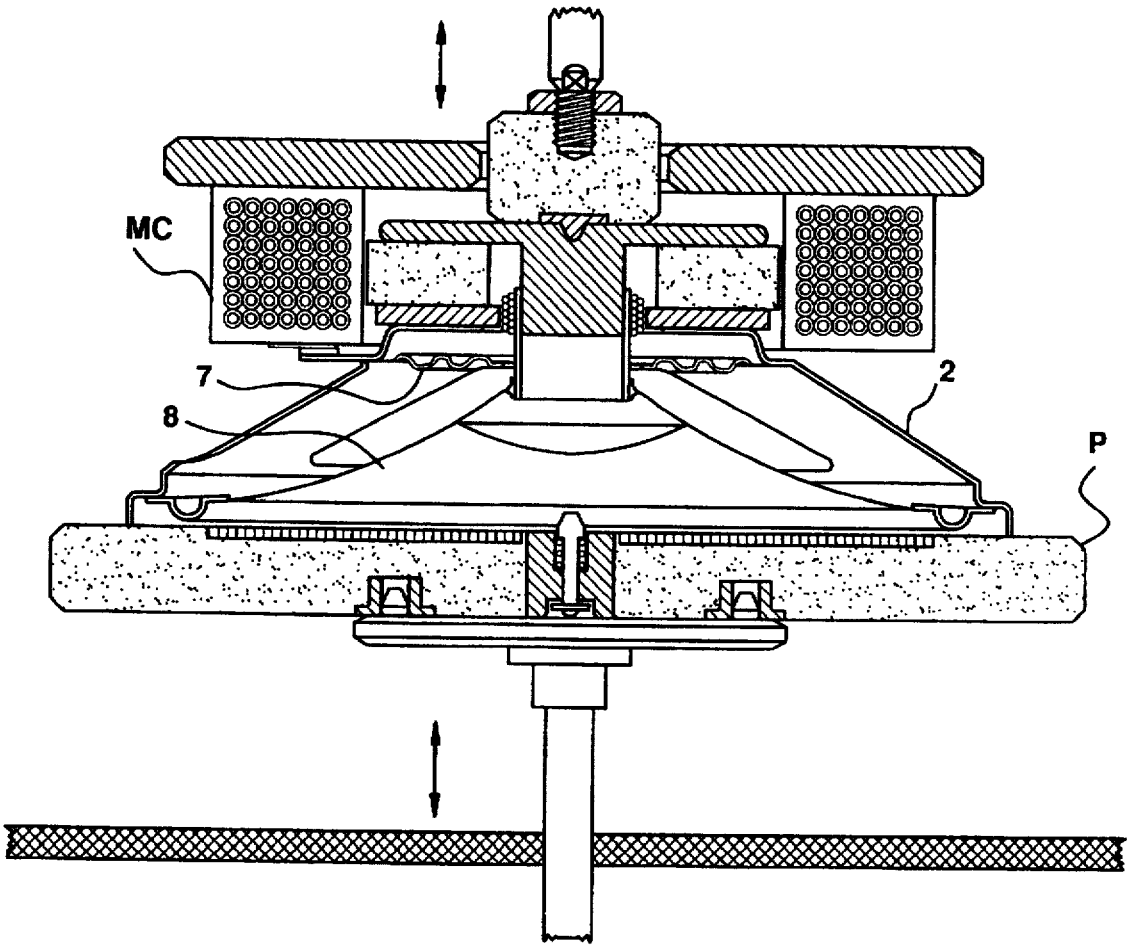
Figure 29A:
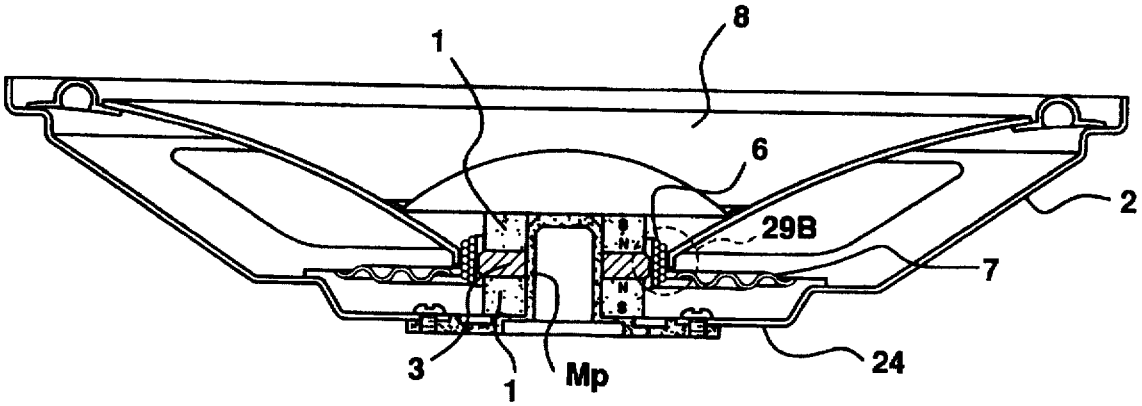
FIG. 29 is a cross sectional view and a partial enlarged cross sectional view of a repulsion magnetic circuit type loudspeaker proposed by the present applicant.
Figure 29B:
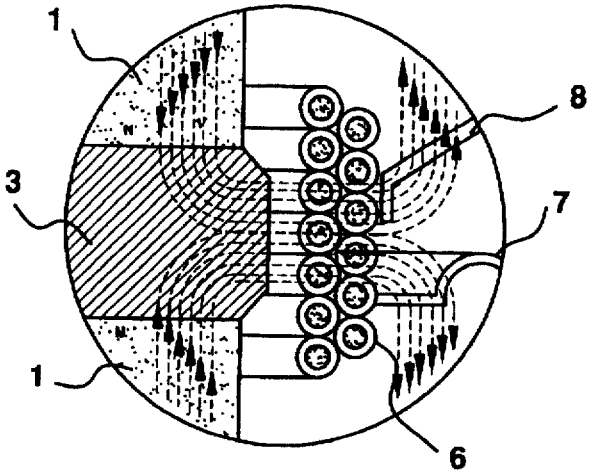
Figure 30:
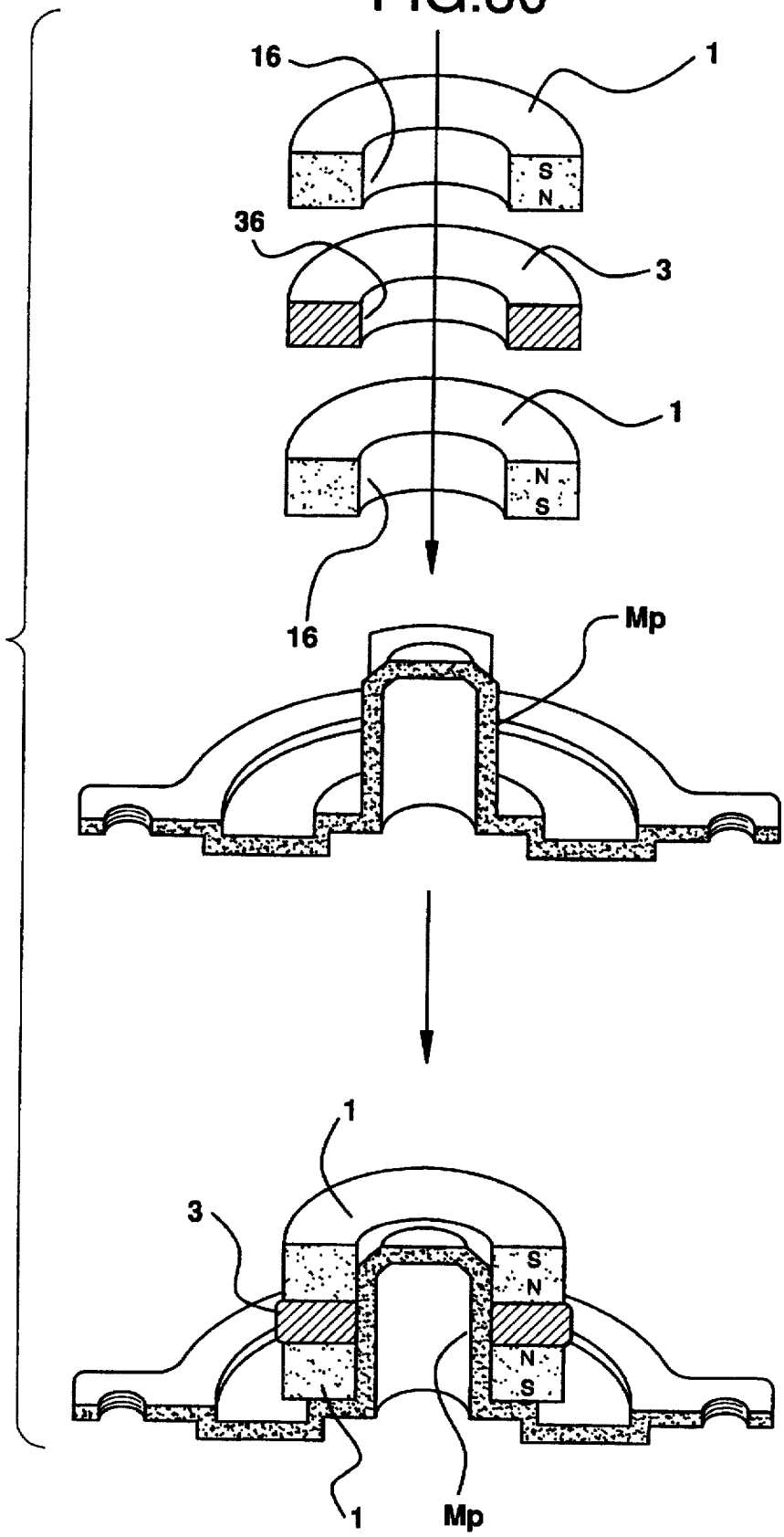
FIG. 30 is a perspective view partially in section of the repulsion magnetic circuit shown in FIG. 29.
Figure 31:
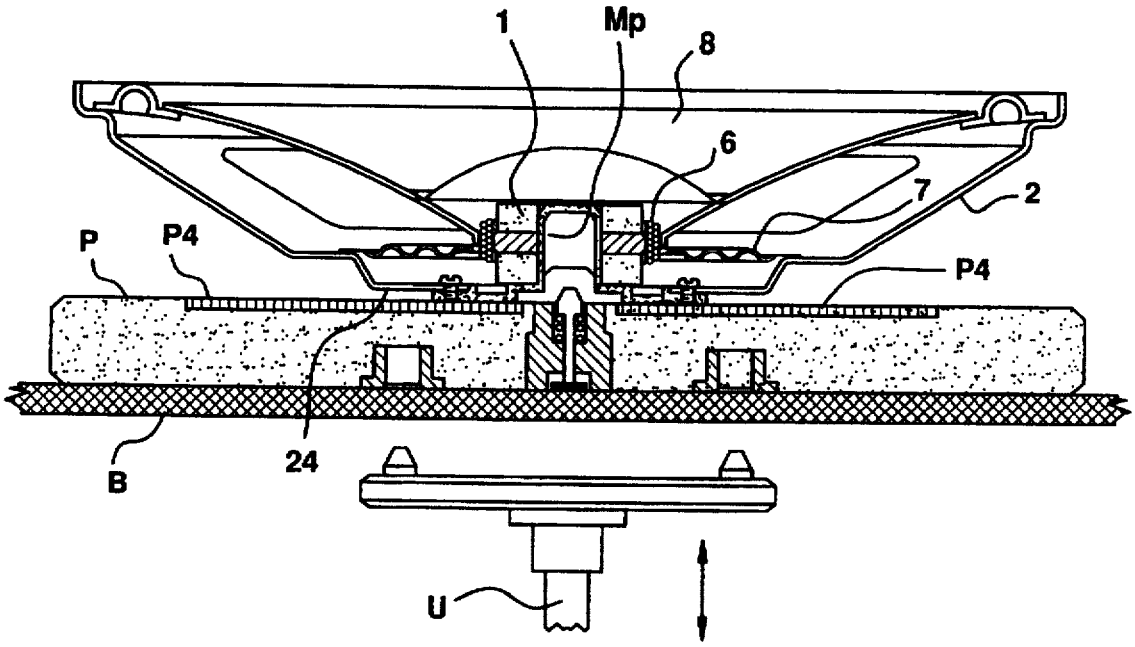
FIG. 31 is a cross sectional view showing the relationship between the repulsion magnetic circuit type loudspeaker shown in FIG. 29 and a transport pallet on a manufacturing line.

In the above-described embodiments, a loudspeaker having no magnetic gap at the center plate outer periphery 33 of the repulsion magnetic circuit has been used. In the case of a loudspeaker shown in FIG. 15 and having a magnetic gap G by providing an outer ring O1 or the like at the outer periphery 33 of the center plate 3, after a repulsion magnetic circuit is assembled by mounting a magnetic circuit holder H made of non-magnetic material or by integrally molding the holder H and a speaker frame 2, the outer ring O1 is pressure-fitted about the outer periphery of the magnetic circuit by mounting a guide jig J5 such as a gap jig Jg on the magnetic circuit. In FIG. 15, J6 represents an outer ring pressure-fitting jig, and Op represents a tip of a pressure-fitting press for the outer ring O1. In the above-described embodiments, the transport pallet P is provided with the magnet sheet P4. For the lines dedicated to the loudspeaker of this invention, the transport pallet P may be provided with a soft magnetic member such as an iron plate in place of the magnetic sheet P4.

According to a loudspeaker manufacturing method of this invention, a repulsion magnetic circuit is assembled by using already magnetized magnets and thereafter vibrating system components are assembled. The magnetic member mounted on the transport pallet is magnetized in the same direction as the lower magnet of the magnetic circuit. The magnetic force of this lower magnet generates a force sufficient for holding an unfinished loudspeaker product in position on the transport pallet. Accordingly, the unfinished loudspeaker on the transport pallet can be transported to each line while being held in position on the transport pallet, and a slippage phenomenon at the time of coating adhesive agent will not occur.

A coupling member of either a convex or a concave of a desired shape is formed at the predetermined position of the bottom of the magnet of the magnetic circuit, of the bottom of the speaker frame, or of other components. The magnetic circuit and speaker frame are aligned in position by using such coupling members so that the assembly is easy and an assembly displacement can be prevented.

A conical concave or the like is formed at the center of the magnet or frame bottom so that the transport pallet, magnet, and frame bottom can be aligned in position in the manner quite the same as conventional. Therefore, a conventional assembly line can be used without any modification. This method is therefore very advantageous. Namely, conventional lines can be used only by adding an assembly line for a repulsion magnetic circuit, considerably reducing the manufacturing facility cost. A conventional magnet sheet may be used by magnetizing it in a particular direction. An assembly line can be therefore used not only for repulsion magnetic circuit type loudspeakers but also conventional general loudspeakers.

A neodymium magnet can have an outer dimension precision relatively easily. In the assembly method for a repulsion magnetic circuit, by using a jig with a hole having an inner diameter matching the outer diameter of the center plate, or by using a jig with a hole having an inner diameter matching the outer diameter of the magnet, repulsion magnetic circuit components such as the magnet and center plate are inserted into the hole of the jig and the assembly is performed by using as a standard assembly guide the outer periphery of the center plate or magnet. Therefore, the mass production of a repulsion magnetic circuit becomes easy. Furthermore, the magnetic circuit can be made smaller than that of a repulsion magnetic circuit type loudspeaker already proposed by the present applicant. It is therefore possible to perform a mass production of a loudspeaker which is lighter, thinner, and smaller.

A manufactured repulsion magnetic circuit type loudspeaker has a structure that a magnet is not required to have a mount hole for mounting the magnetic circuit on a loudspeaker. Accordingly, it is possible to make a loudspeaker compact and provide an optimum repulsion magnetic circuit type loudspeaker.

What is claimed is:

1. A method of manufacturing a loudspeaker having a magnetic circuit comprising two magnets magnetized in the thickness direction and disposed with like poles of said two magnets facing each other and a center plate made of soft magnetic material and squeezed between the two magnets, a magnetic field of repulsion fluxes being generated at the outer peripheral area of the center plate, and a vibrating system having a voice coil, the method comprising; magnetizing said two magnets in the thickness direction prior to a step of assembling them into the magnetic circuit, assembling the magnetized two magnets and the center plate into the magnetic circuit so that like poles of said magnetized two magnets face each other and the center plate is squeezed between the magnetized two magnets, mounting the assembled magnetic circuit on a speaker frame while restricting a lateral movement of the magnetic circuit with respect to the speaker frame, and fixing said vibrating system to the speaker frame so that the voice coil of the vibrating system is disposed in the magnetic field generated at the outer peripheral area of the center plate in the assembled magnetic circuit mounted on the speaker frame.

2. A method of manufacturing a loudspeaker having a magnetic circuit comprising two magnets magnetized in the thickness direction disposed with like poles of said two magnets facing each other and a center plate made of soft magnetic material and squeezed between the two magnets, a magnetic field of repulsion fluxes being generated at the outer peripheral area of the center plate, and a vibrating system being assembled so as to dispose a voice coil being disposed in the magnetic field, the method comprising;

magnetizing said two magnets prior to a step of assembling them into the magnetic circuit, placing one of said two magnetized magnets on the bottom of a speaker frame, positioning the center plate onto the upper surface of said one of two magnetized magnets placed on the bottom of the speaker frame, and then attaching the other of said two magnetized magnets onto the upper surface of the center plate positioned onto said one of two magnetized magnets so that the same polarity of said two magnets is faced each other.

3. A method according to claim 2, further comprising a step of disposing a magnetic circuit assembly jig formed with a hole having a size matching the outer periphery of said center plate at a predetermined position of the bottom of a speaker frame, and assembling said magnetic circuit by inserting said magnet and said center plate into said hole of said jig.

4. A method according to claim 4, further comprising a step of providing a magnetic circuit assembly jig formed with a hole having a size matching the outer periphery of said center plate or the outer periphery of said magnet, assembling said magnetic circuit by inserting said magnet and said center plate into said hole of said jig, and fitting said magnetic circuit to a predetermined position of said speaker frame.

5. A method according to claim 3, wherein while said magnetic circuit is assembled by disposing said magnetic circuit assembly jig formed with a hole having a size matching the outer periphery of said center plate at said speaker frame, said magnetic circuit is set to a predetermined position of said speaker frame.

6. A method of manufacturing a loudspeaker having a magnetic circuit comprising two magnets magnetized in the thickness direction and disposed with like poles of said two magnets facing each other and a center plate made of soft magnetic material and squeezed between the two magnets, a magnetic field of repulsion fluxes being generated at the outer peripheral area of the center area of the center plate, and a vibrating system being assembled so as to dispose a voice coil being disposed in the magnetic field, the method comprising; mounting a plurality of pins at predetermined positions of a loudspeaker assembly transport pallet, forming holes corresponding to said pins in the bottom of a speaker frame and in a magnetic circuit assembly jig, and assembling said magnetic circuit by inserting said pins into said holes of said speaker frame and said jig.

7. A method of manufacturing a loudspeaker having a magnetic circuit comprising two magnets magnetized in the thickness direction and disposed with like poles facing each other and a center plate made of soft magnetic material and squeezed between the two magnets, a magnetic field of repulsion fluxes being generated at the outer peripheral area of the center plate, and a vibrating system being assembled so as to dispose a voice coil being disposed in the magnetic field, the method comprising; attaching a magnetic chuck to the tip of a loading unit for the assembly of said magnetic circuit, setting the direction of generating a magnetic field of said magnet chuck to a direction opposite to the magnetic field direction of said magnet, and attaching said center plate by said magnet chuck for the assembly and transportation of said magnetic circuit.

8. A method of manufacturing a loudspeaker having a magnetic circuit comprising two magnets magnetized in the thickness direction and disposed with like poles of said two magnets facing each other and a center plate made of soft magnetic material and squeezed between the two magnets, a magnetic field of repulsion fluxes being generated at the outer peripheral area of the center plate, and a vibrating system being assembled so as to dispose a voice coil being disposed in the magnetic field, the method comprising; attaching a magnetic chuck to the tip of a loading unit for supplying and transporting an assembly component during the assembly of said magnetic circuit, and setting the direction of generating a magnetic field of said magnet chuck to a direction opposite to the magnetic field direction of said magnet.

9. A method of manufacturing a loudspeaker having a magnetic circuit comprising two magnets magnetized in the thickness direction and disposed with like poles of said two magnets facing each other and a center plate made of soft magnetic material and squeezed between the two magnets, a magnetic field of repulsion fluxes being generated at the outer peripheral area of the center plate, and a vibrating system being assembled so as to dispose a voice coil being disposed in the magnetic field, the method comprising; mounting a magnetic material member on a loudspeaker transport pallet, and magnetizing said magnetic material member in the same direction as the magnetizing direction of a lower one of said two magnets of said magnetic circuit.

10. A method of manufacturing a loudspeaker having a magnetic circuit comprising two magnets magnetized in the thickness direction and disposed with like poles of said two magnets facing each other and a center pate made of soft magnetic material and squeezed between the two magnets, a magnetic field of repulsion fluxes being generated at the outer peripheral area of the center plate, and a vibrating system being assembled so as to dispose a voice coil being disposed in the magnetic field, the method comprising;

providing concaves and convexes respectively on junction surfaces of one of said two magnets and the center plate and junction surfaces of the other of said two magnets and the center plate, magnetizing said two magnets prior to a step of assembling them into the magnetic circuit, aligning the center plate in the assembling by engaging the concave or convex of the junction surface of the center plate with the convex or concave of the junction surface of said one of magnetized magnet, and then aligning said the other of magnetized magnet in the assembling by engaging the concave or convex of the junction surface of said the other of magnetized magnet with the convex or concave of the junction surface of the center plate.

11. A method of manufacturing a loudspeaker having a magnetic circuit comprising two magnets magnetized in the thickness direction and disposed with like poles of said two magnets facing each other and a center plate made of soft magnetic material and squeezed between the two magnets, a magnetic field of repulsion fluxes being generated at the outer peripheral area of the center plate, and a voice coil being disposed in the magnetic field, the method comprising;

providing concaves and convexes respectively on said two magnets and a speaker frame, magnetizing said two magnets prior to a step of assembling them into the magnetic circuit, assembling said two magnets and the center plate into the magnetic circuit by fixing the center plate onto one of said two magnetized magnets and then fixing the other of said two magnetized magnets onto the center plate previously fixed onto said one of magnetized magnet, and aligning the magnetic circuit with the speaker frame by engaging the concave or convex of the magnetic circuit with the convex or concave of the speaker frame.

12. A method of manufacturing a loudspeaker having a magnetic circuit comprising two magnets magnetized in the thickness direction and disposed with like poles of said two magnets facing each other and a center plate made of soft magnetic material and squeezed between the two magnets, a magnetic field of repulsion fluxes being generated at the outer peripheral area of the center plate, and a vibrating system being assembled so as to dispose a voice coil being disposed in the magnetic field, the method comprising;

providing concaves and convexes respectively on said two magnets and a speaker frame, magnetizing said two magnets prior to a step of assembling them into the magnetic circuit, aligning one of said two magnetized magnets to the speaker frame by engaging the concave or convex of said one of magnetized magnet with the convex or concave of the speaker frame, fixing the center plate onto said one of magnetized magnet mounted on the speaker frame, and then fixing the other of said two magnetized magnets onto the center plate fixed on said one of magnetized magnet.

13. A method of manufacturing a loudspeaker having a magnetic circuit comprising two magnets magnetized in the thickness direction and disposed with like poles of said two magnets facing each other and a center plate made of soft magnetic material and squeezed between the two magnets, a magnetic field of repulsion fluxes being generated at the outer peripheral area of the center plate, and a vibrating system being assembled so as to dispose a voice coil being disposed in the magnetic field, the method comprising;

preparing a carrying pallet for speaker assembling provided with a magnetic piece, magnetizing said two magnets prior to a step of assembling them into the magnetic circuit, fixing a speaker frame by sticking one of said two magnetized magnets through the speaker frame to the magnetic piece of said carrying pallet in disposing the magnetic circuit on the speaker frame, and then assembling the vibrating system.

* * * * *